US008568541B2

(12) United States Patent
Nielson et al.

(10) Patent No.: US 8,568,541 B2
(45) Date of Patent: Oct. 29, 2013

(54) REACTIVE MATERIAL COMPOSITIONS AND PROJECTILES CONTAINING SAME

(75) Inventors: Daniel B. Nielson, Tremonton, UT (US); Benjamin N. Ashcroft, Perry, UT (US); Daniel W. Doll, Marriott Slaterville, UT (US)

(73) Assignee: Alliant Techsystems Inc., Arlington, VA (US)

( * ) Notice: Subject to any disclaimer, the term of this patent is extended or adjusted under 35 U.S.C. 154(b) by 435 days.

(21) Appl. No.: 12/127,627

(22) Filed: May 27, 2008

(65) Prior Publication Data

US 2008/0229963 A1 Sep. 25, 2008

Related U.S. Application Data

(62) Division of application No. 10/801,948, filed on Mar. 15, 2004, now abandoned.

(51) Int. Cl.
*C06B 45/10* (2006.01)
*C06B 33/00* (2006.01)
*D03D 23/00* (2006.01)

(52) U.S. Cl.
USPC ..... 149/19.3; 149/37; 149/108.2

(58) Field of Classification Search
USPC ..... 149/19.3, 37, 108.2
See application file for complete search history.

(56) References Cited

U.S. PATENT DOCUMENTS

| | | | |
|---|---|---|---|
| 359,491 | A | 3/1887 | Bagger |
| 2,217,645 | A | 10/1940 | DeWilde et al. |
| 2,398,287 | A | 4/1946 | Christie |
| 2,425,005 | A | 8/1947 | Rechel |
| 2,446,268 | A | 8/1948 | Dawson |
| 2,703,531 | A | 3/1955 | Graumann et al. |
| 2,961,712 | A | 11/1960 | Davis |
| 3,133,841 | A | 5/1964 | Kuehl |
| 3,158,994 | A | 12/1964 | Hodgson |
| 3,191,535 | A | 6/1965 | Mulloy |
| 3,325,316 | A | 6/1967 | MacDonald |

(Continued)

FOREIGN PATENT DOCUMENTS

| | | |
|---|---|---|
| DE | 315857 | 6/1920 |
| DE | 10224503 A | 12/2002 |

(Continued)

OTHER PUBLICATIONS

UK Search Report of Jul. 1, 2005.

(Continued)

*Primary Examiner* — Aileen B Felton
(74) *Attorney, Agent, or Firm* — TraskBritt

(57) ABSTRACT

A reactive material that includes at least one of a fuel, an oxidizer, and a class 1.1 explosive and is formulated for use in a reactive material projectile. The reactive material is formulated to provide at least one of an overpressure of greater than approximately 9 pounds per square inch at a radial measurement of 12 inches from a point of impact on a target, a hole greater than approximately 2 square inches at an optimum penetration level in a target, and pressure, damage, and a flame when the reactive material bullet impacts a target. The fuel may be a metal, a fusible metal alloy, an organic fuel, or mixtures thereof. The oxidizer may be an inorganic oxidizer, sulfur, a fluoropolymer, or mixtures thereof. A reactive material projectile having the reactive material disposed therein is also disclosed.

13 Claims, 27 Drawing Sheets

(56) References Cited

U.S. PATENT DOCUMENTS

| | | | | |
|---|---|---|---|---|
| 3,348,484 | A | | 10/1967 | Grandy |
| 3,414,443 | A | | 12/1968 | Pheasant |
| 3,434,420 | A | | 3/1969 | Ciccone et al. |
| 3,463,047 | A | | 8/1969 | Germershausen |
| 3,669,020 | A | | 6/1972 | Waite et al. |
| 3,677,183 | A | | 7/1972 | Talley |
| 3,730,093 | A | | 5/1973 | Cummings |
| 3,745,076 | A | | 7/1973 | Sickman et al. |
| 3,770,525 | A | * | 11/1973 | Villey-Desmeserets et al. ..... 149/19.3 |
| 3,799,054 | A | | 3/1974 | LaRocca |
| 3,894,867 | A | | 7/1975 | Fishman et al. |
| 3,951,068 | A | | 4/1976 | Schroeder |
| 3,961,576 | A | | 6/1976 | Montgomery, Jr. |
| 3,978,796 | A | | 9/1976 | Hackman |
| 3,980,612 | A | | 9/1976 | Gangal |
| 4,006,687 | A | | 2/1977 | Ridgeway |
| 4,011,818 | A | | 3/1977 | Stosz, Jr. et al. |
| 4,029,868 | A | | 6/1977 | Carlson |
| 4,037,539 | A | | 7/1977 | Hackman |
| 4,096,804 | A | | 6/1978 | Bilsbury |
| 4,106,411 | A | | 8/1978 | Borcher et al. |
| 4,112,846 | A | | 9/1978 | Gilbert et al. |
| 4,131,498 | A | | 12/1978 | Lucy |
| 4,153,661 | A | | 5/1979 | Ree et al. |
| 4,179,992 | A | | 12/1979 | Ramnarace et al. |
| 4,237,787 | A | | 12/1980 | Wacula et al. |
| 4,280,408 | A | | 7/1981 | Weber et al. |
| 4,331,080 | A | | 5/1982 | West et al. |
| 4,348,958 | A | | 9/1982 | Day |
| 4,351,240 | A | | 9/1982 | McCubbin et al. |
| 4,368,296 | A | | 1/1983 | Kuhls et al. |
| 4,381,692 | A | | 5/1983 | Weintraub |
| 4,419,936 | A | | 12/1983 | Coates et al. |
| 4,432,816 | A | | 2/1984 | Kennedy et al. |
| 4,435,481 | A | | 3/1984 | Baldi |
| 4,445,947 | A | | 5/1984 | Shaw, III et al. |
| 4,449,456 | A | | 5/1984 | Foss et al. |
| 4,503,776 | A | | 3/1985 | Nussbaum et al. |
| 4,572,077 | A | | 2/1986 | Antoine et al. |
| 4,612,860 | A | | 9/1986 | Flatau |
| 4,655,139 | A | | 4/1987 | Wilhelm |
| 4,662,280 | A | | 5/1987 | Becker et al. |
| 4,665,113 | A | | 5/1987 | Eberl |
| 4,693,181 | A | | 9/1987 | Dadley et al. |
| 4,747,892 | A | | 5/1988 | Spencer |
| H000540 | H | | 11/1988 | Caponi |
| 4,807,795 | A | | 2/1989 | LaRocca et al. |
| 4,853,294 | A | | 8/1989 | Everett et al. |
| 4,955,939 | A | | 9/1990 | Petrousky et al. |
| 4,958,570 | A | | 9/1990 | Harris |
| 4,970,960 | A | | 11/1990 | Feldmann |
| 4,985,190 | A | | 1/1991 | Ishikawa et al. |
| 5,045,114 | A | | 9/1991 | Bigalk et al. |
| 5,049,212 | A | | 9/1991 | Colick |
| 5,055,539 | A | | 10/1991 | Hengel et al. |
| 5,067,995 | A | | 11/1991 | Nutt |
| H001047 | H | | 5/1992 | Henderson et al. |
| 5,157,225 | A | | 10/1992 | Adams et al. |
| 5,175,392 | A | | 12/1992 | Denis |
| 5,198,616 | A | | 3/1993 | Anderson |
| 5,259,317 | A | | 11/1993 | Lips |
| 5,313,890 | A | | 5/1994 | Cuadros |
| 5,323,707 | A | | 6/1994 | Norton et al. |
| 5,339,624 | A | | 8/1994 | Calsson et al. |
| 5,411,615 | A | | 5/1995 | Sumrail et al. |
| H001504 | H | | 12/1995 | Crabtree |
| 5,472,536 | A | | 12/1995 | Doris et al. |
| 5,474,625 | A | | 12/1995 | Duong et al. |
| 5,518,807 | A | | 5/1996 | Chan et al. |
| 5,531,844 | A | | 7/1996 | Brown et al. |
| 5,535,679 | A | | 7/1996 | Craddock |
| 5,549,948 | A | | 8/1996 | Blong et al. |
| 5,561,260 | A | | 10/1996 | Towning et al. |
| 5,585,594 | A | | 12/1996 | Pelham et al. |
| 5,627,339 | A | | 5/1997 | Brown et al. |
| 5,652,408 | A | | 7/1997 | Nicolas |
| 5,672,843 | A | | 9/1997 | Evans et al. |
| 5,710,217 | A | | 1/1998 | Blong et al. |
| 5,721,392 | A | | 2/1998 | Chan et al. |
| 5,763,519 | A | | 6/1998 | Springsteen |
| 5,792,977 | A | | 8/1998 | Chawla |
| 5,801,325 | A | | 9/1998 | Willer et al. |
| 5,811,726 | A | | 9/1998 | Brown et al. |
| 5,852,256 | A | | 12/1998 | Hornig |
| 5,886,293 | A | | 3/1999 | Nauflett et al. |
| 5,910,638 | A | | 6/1999 | Spencer et al. |
| 5,913,256 | A | | 6/1999 | Lowden et al. |
| 5,945,629 | A | | 8/1999 | Schildknecht et al. |
| 5,997,668 | A | | 12/1999 | Aubert et al. |
| 6,042,702 | A | | 3/2000 | Kolouch et al. |
| 6,105,505 | A | | 8/2000 | Jones |
| 6,115,894 | A | | 9/2000 | Huffman |
| 6,119,600 | A | | 9/2000 | Burri |
| 6,132,536 | A | | 10/2000 | Hohmann et al. |
| 6,186,072 | B1 | | 2/2001 | Hickerson, Jr. et al. |
| 6,293,201 | B1 | | 9/2001 | Consaga |
| 6,308,634 | B1 | | 10/2001 | Fong |
| 6,315,847 | B1 | | 11/2001 | Lee et al. |
| 6,334,394 | B1 | | 1/2002 | Zimmermann et al. |
| 6,354,222 | B1 | | 3/2002 | Becker et al. |
| 6,363,828 | B1 | | 4/2002 | Sherlock et al. |
| 6,371,219 | B1 | | 4/2002 | Collins et al. |
| 6,427,599 | B1 | | 8/2002 | Posson et al. |
| 6,439,315 | B2 | | 8/2002 | Onuki |
| 6,484,642 | B1 | | 11/2002 | Kuhns et al. |
| 6,485,586 | B1 | | 11/2002 | Gill et al. |
| 6,536,351 | B2 | | 3/2003 | Böcker et al. |
| 6,547,993 | B1 | | 4/2003 | Joshi |
| 6,588,344 | B2 | | 7/2003 | Clark et al. |
| 6,593,410 | B2 | | 7/2003 | Nielson et al. |
| 6,635,130 | B2 | | 10/2003 | Koch |
| 6,659,013 | B1 | | 12/2003 | Kellner |
| 6,679,176 | B1 | | 1/2004 | Zavitsanos et al. |
| 6,691,622 | B2 | | 2/2004 | Zavitsanos et al. |
| 6,799,518 | B1 | | 10/2004 | Williams |
| 6,832,740 | B1 | | 12/2004 | Ransom |
| 6,846,372 | B1 | | 1/2005 | Guirguis |
| 6,896,751 | B2 | | 5/2005 | Posson et al. |
| 6,945,175 | B1 | | 9/2005 | Gotzmer et al. |
| 6,962,634 | B2 | | 11/2005 | Nielson et al. |
| 7,000,547 | B2 | | 2/2006 | Amick |
| 7,017,496 | B2 | | 3/2006 | Lloyd |
| 7,040,235 | B1 | | 5/2006 | Lloyd |
| 7,143,698 | B2 | | 12/2006 | Lloyd |
| 7,191,709 | B2 | | 3/2007 | Nechitailo |
| 7,194,961 | B1 | | 3/2007 | Nechitailo |
| 7,231,876 | B2 | | 6/2007 | Kellner |
| 7,278,353 | B2 | | 10/2007 | Langan et al. |
| 7,278,354 | B1 | | 10/2007 | Langan et al. |
| 7,307,117 | B2 | | 12/2007 | Nielson et al. |
| 7,380,503 | B2 | | 6/2008 | Williams et al. |
| 7,603,951 | B2 | | 10/2009 | Rose et al. |
| 7,614,348 | B2 | | 11/2009 | Truitt et al. |
| 7,621,222 | B2 | | 11/2009 | Lloyd |
| 2003/0140811 | A1 | | 7/2003 | Bone |
| 2004/0116576 | A1 | | 6/2004 | Nielson |
| 2005/0067072 | A1 | | 3/2005 | Vavrick |
| 2005/0087088 | A1 | | 4/2005 | Lacy et al. |
| 2005/0183618 | A1 | | 8/2005 | Nechitailo |
| 2005/0199323 | A1 | | 9/2005 | Nielson et al. |
| 2006/0011086 | A1 | | 1/2006 | Rose et al. |
| 2006/0086279 | A1 | | 4/2006 | Lloyd |
| 2006/0144281 | A1 | | 7/2006 | Williams et al. |
| 2007/0272112 | A1 | | 11/2007 | Nielson et al. |
| 2008/0035007 | A1 | | 2/2008 | Nielson et al. |
| 2008/0202373 | A1 | | 8/2008 | Hugus et al. |
| 2009/0211484 | A1 | | 8/2009 | Truitt et al. |
| 2009/0320711 | A1 | | 12/2009 | Lloyd |

FOREIGN PATENT DOCUMENTS

| | | |
|---|---|---|
| EP | 0051375 | 1/1989 |
| EP | 0 487 472 | 5/1992 |

(56) References Cited

FOREIGN PATENT DOCUMENTS

| | | | |
|---|---|---|---|
| EP | 0 487 473 | | 5/1992 |
| EP | 0 684 938 | | 12/1995 |
| EP | 0770449 | A1 | 5/1997 |
| FR | 856233 | | 6/1940 |
| FR | 2749382 | | 12/1997 |
| FR | 2749382 | A1 | 12/1997 |
| GB | 384966 | A | 12/1932 |
| GB | 488909 | A | 7/1938 |
| GB | 588671 | A | 11/1944 |
| GB | 839872 | | 6/1960 |
| GB | 968507 | A | 11/1960 |
| GB | 1007227 | | 10/1965 |
| GB | 1 591 092 | A | 6/1981 |
| RU | 2100763 | C1 | 12/1997 |
| WO | WO 93/21135 | | 10/1993 |
| WO | WO 96/07700 | A | 3/1996 |
| WO | 9918050 | A1 | 4/1999 |
| WO | WO 0062009 Al | | 10/2000 |
| WO | WO 0177607 | | 10/2001 |
| WO | WO 02/00741 | A | 1/2002 |
| WO | 0240213 | A1 | 5/2002 |

OTHER PUBLICATIONS

Search Report for French Application No. 0502374, dated Oct. 24, 2007.
Search Report for French Application No. 0502373, dated Oct. 18, 2007.
PCT International Search Report for International Application No. PCT/US2007/076672, mailed Jul. 28, 2008.
Fischer, S.H., et al., "Theoretical Energy Release of Thermites, Intermetallics, and Combustible Metals," To be presented at the 24th International Pyrotechnics Seminar, Monterey, CA, Jul. 1998, 61 pages.
DuPont Fluoropolymers Food Processing and Industrial Bakeware Coatings http://www.dupont.com/teflon/bakeware/power.html ©2003 E.I. DuPont de Nemours and Company.
DuPont Teflon® Industrial Coatings http://www.dupont.com/teflon/coatings/basic_types.html ©2003 E.I. DuPont de Nemours and Company.
Hackh'S Chemical Dictionary 4th Ed. Dec. 4, 1974 p. 663.
Indium Corporation of America Europe and Asia Indalloy Speciality Alloys Mechanical Properties as viewed at www.indium.com on Aug. 7, 2006.
Lycos Wired News Adding More Bang to Navy Missiles 5 pages Dec. 26, 2002 http://wired.com.
Partial European Search Report for European Application No. 06020829 dated Oct. 30, 2007.
Partial European Search Report for EP Application No. 03006174 mailed Jul. 20, 2004.
Patriot Air & Missile Defense System: How Patriot Works http://static.howstuffworks.com © 2002 Raytheon Company.
Patriot Advanced Capability-3 (PAC-3) 17 pages Various Dates as viewed at http://www.missilethreat.com on Nov. 27, 2006.
Reactive Tungsten Alloy for Inert Warheads Navy SBIR FY2004.2 1 page.
Reactive Materials Advanced Energetic Materials (2004) http://www.nap.com ©2004, The National Academy of Sciences pp. 20-23.
Search Report for French Application No. 0502466, dated Nov. 8, 2005 prepared by the EPO for the French Patent Office.
SpaceRef.com Better Warheads Through Plastics from Defense Advanced Research Projects Agency (DARPA) 2 pages Dec. 2, 2002 http://www.spaceref.com.
The Ordnance Shop Sidewinder Guided Missile 3 pages as viewed at http://www.ordnance.org on Jul. 26, 2006.
UK Search Report of Jun. 8, 2005 for Great Britain Application No. GB0505220.4.
UK Search Report of Jun. 29, 2005 for Great Britain Application No. GB0505222.0.
U.S. Appl. No. 11/690,016, filed Mar. 22, 2007 entitled Reactive Material Compositions Shot Shells Including Reactive Materials and a Method of Producing Same.
U.S. Appl. No. 11/538,763, filed Oct. 4, 2006 entitled Reactive Material Enhanced Projectiles and Related Methods.
U.S. Appl. No. 10/801,946, filed Mar. 15, 2004 entitled Reactive Compositions Including Metal and Methods of Forming Same.
U.S. Appl. No. 11/512,058, filed Aug. 29, 2006 entitled Weapons and Weapon Components Incorporating Reactive Materials and Related Method.
Zumdahl Steven S. Chemistry pp. 931-934 (no date).
3M Material Safety Data Sheet pp. 1-7 ©2005 3M Company.
Fischer et al., "A survey in combustible metals, thermites, and intermetallics for pyrotechnic applications", published by Sandia National Laboratories (SAND 95-3448C), presented at AIAA/ASME/SAE/ASEE Joint Propulsion Conference, Lake Buena Vista, FL. Jul. 1-3, 1996, pp. 1-13.

* cited by examiner

REACTIVE MATERIAL COMPOSITIONS AND PROJECTILES CONTAINING SAME

CROSS-REFERENCE TO RELATED APPLICATION

This application is a divisional of U.S. patent application Ser. No. 10/801,948, filed Mar. 15, 2004, abandoned. The disclosure of the previously referenced U.S. patent application is hereby incorporated by reference in its entirety.

The present application is related to U.S. Provisional Patent Application No. 60/368,284, filed Mar. 28, 2002, entitled Low Temperature, Extrudable, High Density Reactive Materials, now abandoned; U.S. Pat. No. 6,962,634, issued Nov. 8, 2005, entitled Low Temperature, Extrudable, High Density Reactive Materials; U.S. patent application Ser. No. 12/507,605, filed Jul. 22, 2009, entitled Low Temperature, Extrudable, High Density Reactive Materials, pending; U.S. Provisional Patent Application No. 60/184,316, filed Feb. 23, 2000, entitled High Strength Reactive Materials, now abandoned; U.S. Pat. No. 6,593,410, issued Jul. 15, 2003, entitled High Strength Reactive Materials; U.S. Pat. No. 7,307,117, issued Dec. 11, 2007, entitled High Strength Reactive Materials And Methods Of Making; U.S. patent application Ser. No. 10/801,946, filed Mar. 15, 2004, entitled Reactive Compositions Including Metal, now abandoned; U.S. patent application Ser. No. 11/620,205, filed Jan. 5, 2007, entitled Reactive Compositions Including Metal, now U.S. Pat. No. 8,075,715, issued Dec. 13, 2011; U.S. Provisional Application No. 60/553,430, filed Mar. 15, 2004, entitled Reactive Material Enhanced Projectiles and Related Methods, now abandoned; U.S. Pat. No. 7,603,951, issued Oct. 20, 2009, entitled Reactive Material Enhanced Projectiles and Related Methods; U.S. Provisional Application No. 60/723,465, filed Oct. 4, 2005, entitled Reactive Material Enhanced Projectiles And Related Methods, now abandoned; U.S. patent application Ser. No. 11/538,763, filed Oct. 4, 2006, entitled Reactive Material Enhanced Projectiles And Related Methods, now U.S. Pat. No. 8,122,833, issued Feb. 28, 2012; U.S. Pat. No. 7,614,348, issued Nov. 10, 2009, entitled Weapons And Weapon Components Incorporating Reactive Materials And Related Methods; U.S. patent application Ser. No. 11/697,005, filed Apr. 5, 2007, entitled Consumable Reactive Material Fragments, Ordnance Incorporating Structures For Producing The Same, And Methods Of Creating The Same, pending; and U.S. patent application Ser. No. 11/690,016, filed Mar. 22, 2007, entitled Reactive Material Compositions, Shot Shells Including Reactive Materials, and a Method of Producing Same, now U.S. Pat. No. 7,977,420, issued Jul. 12, 2011.

FIELD OF THE INVENTION

The present invention relates to reactive materials and, more specifically, to reactive materials suitable for use in ammunition, such as a reactive material projectile, as well as to munitions in the form of projectiles containing the reactive materials.

BACKGROUND OF THE INVENTION

Historically, it has been difficult to inflict catastrophic damage on thin-skinned targets using a long-range gun. The problem is even more pronounced with thin-skinned, fuel filled targets, such as fuel tanks, fuel containers, or fuel storage facilities. Conventional projectiles, such as MK211, M8, or M20 armor piercing incendiary ("API") projectiles, are designed to penetrate armor plating and to provide an incendiary flash. To provide the penetrating effects, the MK211, M8, and M20 API projectiles typically include a fill material that is an incendiary composition. For instance, in the MK211, the fill material includes zirconium sandwiched between Composition B. While these projectiles penetrate thin-skinned targets, the fill material does not initiate when the projectiles come into contact with the target surface. Rather, the projectiles pass through the thin-skinned target and do not ignite fuel that is contained within it. As such, the MK211, M8, and M20 API projectiles have limited effectiveness against thin-skinned targets.

A fill material for use in an armor-piercing projectile is disclosed in U.S. Pat. No. 4,237,787 to Wacula et al. The fill material is an incendiary composition that includes aluminum or magnesium, a nitrate or peroxide of potassium, strontium, or barium, and a binder, such as a chlorinated binder. U.S. Pat. No. 4,112,846 to Gilbert et al. discloses an incendiary material having a first metal, which interacts with a second metal to form an intermetallic compound. The first metal is zirconium, titanium, thorium, hafnium, uranium, or mixtures thereof and is present from 70-98.5% by weight. The second metal is tin, lead, or mixtures thereof and is present from 1.5-30% by weight. Incendiary compositions having various properties have also been disclosed. In U.S. Pat. No. 6,485,586 to Gill et al., a low burning rate, high temperature incendiary composition is disclosed. The incendiary composition includes titanium, boron, polytetrafluoroethylene ("PTFE" or TEFLON®), and paraffin wax.

Incendiary materials have also been used as liners in projectiles, such as in warheads. In U.S. Pat. No. 4,381,692 to Weintraub, a quasi alloy zirconium ("QAZ®") material is disclosed for use in munitions. QAZ® includes a long chain epoxy and a powdered metal mixture of zirconium, aluminum, hafnium, magnesium, antimony, tin, and iron. Reactive or energetic materials have also been disclosed for use as liners in projectiles. A known reactive material includes a composition of aluminum and PTFE, as disclosed in U.S. Pat. No. 6,547,993 to Joshi. In U.S. Pat. No. 5,886,293 to Nauflett et al., a process of producing energetic materials for use in military pyrotechnics is disclosed. The energetic material includes a magnesium fluoropolymer, specifically magnesium/TEFLON®/VITON® ("MTV").

In order to defeat thin-skinned targets and particularly those housing flammable materials, such as fuels, it would be desirable to produce projectiles that initiate on contact with the thin-skinned target. Therefore, it would be desirable to formulate fill materials that provide a higher energy output than those currently used, such as in the MK211.

BRIEF SUMMARY OF THE INVENTION

The present invention comprises a reactive material that includes reactive material components from at least two of the following three component categories: at least one fuel, at least one oxidizer, and at least one class 1.1 explosive. The reactive material is formulated for use in a reactive material projectile, such as a bullet, and to provide at least one of an overpressure of greater than approximately 9 pounds per square inch at a radial measurement of 12 inches from a point of impact on a target, a hole greater than approximately 2 square inches at an optimum penetration level in a target, and pressure, damage, and a flame when the reactive material projectile impacts a target. The reactive material may be formulated to initiate upon impact of the projectile with a target.

The at least one fuel may be selected from the group consisting of a metal, a fusible metal alloy, an organic fuel, and mixtures thereof. A suitable metal for the fuel may be selected from the group consisting of hafnium, tantalum, nickel, zinc, tin, silicon, palladium, bismuth, iron, copper, phosphorus, aluminum, tungsten, zirconium, magnesium, boron, titanium, sulfur, magnalium, and mixtures thereof. A suitable organic for the fuel may be selected from the group consisting of phenolphthalein and hexa(ammine)cobalt(III)nitrate. A suitable, fusible metal alloy for the fuel may include at least one metal selected from the group consisting of bismuth, lead, tin, cadmium, indium, mercury, antimony, copper, gold, silver, and zinc. In one embodiment, the fusible metal alloy may have a composition of about 57% bismuth, about 26% indium, and about 17% tin.

The at least one oxidizer may be selected from the group consisting of an inorganic oxidizer, sulfur, a fluoropolymer, and mixtures thereof. The at least one oxidizer may be an alkali or alkaline metal nitrate, an alkali or alkaline metal perchlorate, or an alkaline metal peroxide. For instance, the at least one oxidizer may be ammonium perchlorate, potassium perchlorate, potassium nitrate, strontium nitrate, basic copper nitrate, ammonium nitrate, cupric oxide, tungsten oxides, silicon dioxide, manganese dioxide, molybdenum trioxide, bismuth oxides, iron oxide, molybdenum trioxide, or mixtures thereof. The at least one oxidizer may also be selected from the group consisting of polytetrafluoroethylene, a thermoplastic terpolymer of tetrafluoroethylene, hexafluoropropylene, and vinylidene fluoride, and a copolymer of vinylidenefluoride hexafluoropropylene.

The at least one class 1.1 explosive maybe selected from the group consisting of trinitrotoluene, cyclo-1,3,5-trimethylene-2,4,6-trinitramine, cyclotetramethylene tetranitramine, hexanitrohexaazaisowurtzitane, 4,10-dinitro-2,6,8,12-tetraoxa-4,10-diazatetracyclo-[5.5.0.0$^{5,9}$.0$^{3,11}$]-dodecane, 1,3,3-trinitroazetine, ammonium dinitramide, 2,4,6-trinitro-1,3,5-benzenetriamine, dinitrotoluene, and mixtures thereof. The reactive material may also include at least one binder selected from the group consisting of polyurethanes, epoxies, polyesters, nylons, cellulose acetate butyrate, ethyl cellulose, silicone, graphite, and (bis(2,2-dinitropropyl)acetal/bis(2,2-dinitropropyl) formal).

In one embodiment, the reactive material includes tungsten, potassium perchlorate, and a copolymer of vinylidenefluoride-hexafluoropropylene. In another embodiment, the reactive material includes bismuth, indium, tin, potassium perchlorate, cellulose acetate butyrate, and (bis(2,2-dinitropropyl)acetal/bis(2,2-dinitropropyl)formal). In another embodiment, the reactive material includes aluminum, zirconium, and a copolymer of vinylidenefluoride-hexafluoropropylene. In another embodiment, the reactive material includes magnesium, cupric oxide, and a copolymer of vinylidenefluoride-hexafluoropropylene. In another embodiment, the reactive material includes hafnium and a thermoplastic terpolymer of tetrafluoroethylene, hexafluoropropylene, and vinylidene fluoride. In another embodiment, the reactive material includes aluminum, boron, and a copolymer of vinylidenefluoride-hexafluoropropylene. In another embodiment, the reactive material includes zirconium and polytetrafluoroethylene. In another embodiment, the reactive material includes bismuth, indium, tin, and potassium perchlorate.

In another embodiment, the reactive material includes cyclotetramethylene tetranitramine, cellulose acetate butyrate, and (bis(2,2-dinitropropyl)acetal/bis(2,2-dinitropropyl) formal). In another embodiment, the reactive material includes aluminum, potassium perchlorate, silicon, and a thermoplastic terpolymer of tetrafluoroethylene, hexafluoropropylene, and vinylidene fluoride. In another embodiment, the reactive material includes bismuth, indium, tin, aluminum, silicon, sulfur, potassium perchlorate, bisazidomethyloxetane, glycidylazide plasticizer, and (bis(2,2-dinitropropyl)acetal/bis(2,2-dinitropropyl)formal). In another embodiment, the reactive material includes cyclotetramethylene tetranitramine, cellulose acetate butyrate, (bis(2,2-dinitropropyl)acetal/bis(2,2-dinitropropyl)formal), aluminum, potassium perchlorate, silicon, and a thermoplastic terpolymer of tetrafluoroethylene, hexafluoropropylene, and vinylidene fluoride. In another embodiment, the reactive material includes zirconium and a thermoplastic terpolymer of tetrafluoroethylene, hexafluoropropylene, and vinylidene fluoride.

The present invention also comprises a reactive material projectile, which may be referred to as a "bullet" for convenience and not limitation as to configuration or caliber, that includes a chamber or cavity therein containing the reactive material. In an exemplary embodiment, the projectile may be configured as a case containing at least one reactive material, and a tip. The at least one reactive material may be one, or a combination of two or more of, the reactive materials referenced above. The technique employed to convey the projectile to a target may be entirely conventional, and the technique selected in any given instance is nonlimiting as to the scope of the present invention.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION OF THE INVENTION

Figure 1:
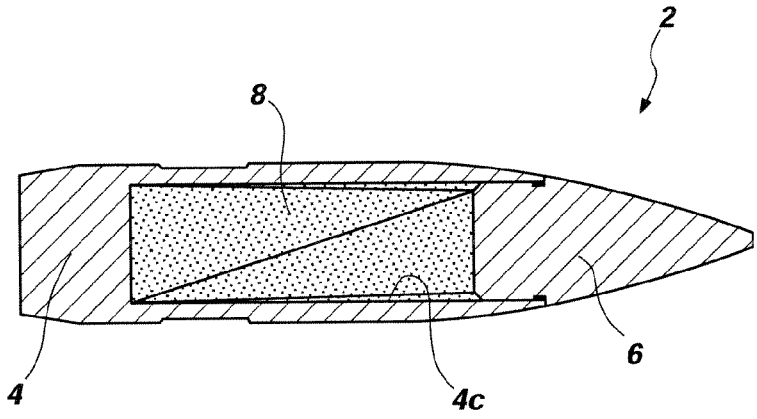
FIG. 1 is a schematic of an exemplary reactive material bullet that includes a reactive material of the present invention.

A reactive material that is suitable for use in a projectile is disclosed. Upon initiation, the reactive material produces an energy output or release that is greater than the energy output of the fill material used in the MK211 projectile. The reactive material may also have a higher density than that of a conventional fill material. The reactive material may be a high energy pyrotechnic composition. As used herein, the term "pyrotechnic composition" refers to a composition that produces light, heat, motion, noise, pressure, or smoke when initiated. The reactive material may be used as a fill material in the projectile, such as in a bullet. The reactive material may provide enhanced performance to a projectile in comparison to that provided by conventional fill materials, in at least one of pressure release, earlier initiation, later initiation, fireball intensity, and target damage. By modifying the components and their relative amounts in the reactive material, the energy release of the reactive material may be tailored to specific target requirements so that damage to a target having known or projected characteristics may be maximized. Furthermore, by varying mechanical properties, such as material and configuration of a case and tip of the reactive material projectile, and matching those mechanical properties with a selected reactive material of the present invention, tailorable initiation and energy release may be achieved.

The reactive material may be an intermetallic-type composition, a thermite-type composition, or a class 1.1 explosive-type composition that includes reactive material components from at least two of the following three component categories: at least one fuel, at least one oxidizer, and at least one class 1.1 explosive. The reactive material may also include more than one fuel, more than one oxidizer, or more than one class 1.1 explosive. The relative amounts of the fuel, the oxidizer, or the class 1.1 explosive present in the reactive material may be varied depending on the desired properties of the reactive material. The fuel may be present in the reactive material from approximately 15% by weight to approximately 90% by weight, depending on the type of fuel that is used. Percentages of each of the components in the reactive material are expressed as percentages by weight ("wt %") of the total weight of the reactive material. The fuel may be a metal, an organic fuel, a fusible metal alloy, or mixtures thereof.

The metal used as a fuel may be hafnium (Hf), aluminum (Al), tungsten (W), zirconium (Zr), magnesium (Mg), boron (B), titanium (Ti), sulfur (S), tantalum (Ta), nickel (Ni), zinc (Zn), tin (Sn), silicon (Si), palladium (Pd), bismuth (Bi), iron (Fe), copper (Cu), phosphorus (P), magnalium (an alloy of Al and Mg), or mixtures thereof. For instance, aluminum may be used in combination with other elements, such as hafnium, boron, or zirconium, to form intermetallic-type reactive materials. The metal may have a particle size ranging from approximately 20 nm to approximately 300 μm. For the sake of example only, the metal may be present in the reactive material in an amount ranging from approximately 10% to approximately 90%.

The fuel may also be an organic fuel, such as phenolphthalein or hexa(ammine)cobalt(III)nitrate ("HACN"). The organic fuel may be present in the reactive material from approximately 15% to approximately 80%.

Further, the fuel may be a fusible metal alloy. Fusible metal alloys are known in the art and are commercially available from sources including, but not limited to, Indium Corp. of America (Utica, N.Y.), Alchemy Castings (Ontario, Canada, and Johnson Mathey PLC (Wayne, Pa.). The fusible metal alloy may be a eutectic or a noneutectic alloy and may include transition metals and post-transition metals, such as metals from Group III, Group IV, and/or Group V of the Periodic Table of the Elements. The metals used in the fusible metal alloy may include, but are not limited to, Bi, lead (Pb), Sn, cadmium (Cd), indium (In), mercury (Hg), antimony (Sb), Cu, gold (Au), silver (Ag), Zn, and mixtures thereof. For the sake of example only, the fusible metal alloy may be Wood's Metal, which has 50% Bi, 25% Pb, 12.5% Sn, and 12.5% Cd and is available from Sigma-Aldrich Co. (St. Louis, Mo.). Wood's Metal has a melting point of approximately 70° C. and a density of 9.58 g/cm$^3$. The fusible metal alloy may also be INDALLOY® 174, which has 57% Bi,26% In, and 17% Sn. INDALLOY® 174 has a melting point of 174° F. (approximately 79° C.), a density of 8.54 g/cm$^3$, and is commercially available from Indium Corp. of America. Other INDALLOY® materials are available from Indium Corp. of America and may be used in the reactive material. INDALLOY® materials are available in a range of melting points (from approximately 60° C. to approximately 300° C.) and include a variety of different metals. As such, the fusible metal alloy for use in the reactive material may be selected depending on the desired melting point. The fusible metal alloy may be present in the reactive material from approximately 14% to approximately 86%.

The oxidizer may be present in the reactive material from approximately 10% to approximately 81%, depending on the oxidizer used. The oxidizer used in the reactive material may be an inorganic oxidizer, such as an ammonium nitrate, an alkali metal nitrate, an alkaline earth nitrate, an ammonium perchlorate, an alkali metal perchlorate, an alkaline earth perchlorate, an ammonium peroxide, an alkali metal peroxide, or an alkaline earth peroxide. The inorganic oxidizer may include, but is not limited to, ammonium perchlorate ("AP"), potassium perchlorate ("KP"), potassium nitrate ($KNO_3$), or strontium nitrate ($SrNO_3$). The inorganic oxidizer may have a particle size ranging from approximately 1 μm to approximately 250 μm. The perchlorate or nitrate inorganic oxidizer may be present from approximately 10% to approximately 90%. The inorganic oxidizer may also be a transition metal-based oxidizer, such as a copper-based, an iron-based, or a molybdenum-based oxidizer, that includes, but is not limited to, basic copper nitrate ($[Cu_2(OH)_3NO_3]$) ("BCN"), cupric oxide (CuO), iron oxide ($Fe_2O_3$), or molybdenum trioxide ($MoO_3$). The transition metal-based oxidizer may be present from approximately 18% to approximately 78%. The transition metal-based oxidizer may have a particle size ranging from approximately 20 nm to approximately 200 μm. The oxidizer may also be a nonoxygen containing compound, such as sulfur or a fluoropolymer, such as PTFE, a thermoplastic terpolymer of tetrafluoroethylene, hexafluoropropylene, and vinylidene fluoride ("THV"), or a fluoroelastomer. Examples of fluoropolymers include, but are not limited to TEFLON®, which is available from DuPont (Wilmington, Del.), THV220 or THV500, which are available from Dyneon LLC (Oakdale, Minn.), and VITON®, which is a copolymer of vinylidenefluoride-hexafluoropropylene and is available from DuPont Dow Elastomers LLC (Wilmington, Del.). The fluoropolymer may also function as a binder in the reactive material. The fluoropolymer may be present from approximately 5% to approximately 74%.

The class 1.1 explosive may be present in the reactive material from approximately 14 wt % to approximately 94 wt %. The class 1.1 explosive may be an energetic solid fuel, such as trinitrotoluene ("TNT"); cyclo-1,3,5-trimethylene-2,4,6-trinitramine ("RDX," also known as hexogen or cyclonite); cyclotetramethylene tetranitramine ("HMX," also known as octogen); hexanitrohexaazaisowurtzitane ("CL-20," also known as HNIW); 4,10-dinitro-2,6,8,12-tetraoxa-4,10-diazatetracyclo-[$5.5.0.0^{5,9}.0^{3,11}$]-dodecane ("TEX"); 1,3,3-trinitroazetine ("TNAZ"); ammonium dinitramide ("ADN"); 2,4,6-trinitro-1,3,5-benzenetriamine ("TATB"); dinitrotoluene ("DNT"); dinitroanisole ("DNAN"), and mixtures thereof. The energetic solid fuel may have a particle size ranging from approximately 1 μm to approximately 150 μm.

The reactive material may optionally include additional ingredients, such as at least one of a binder, a processing aid, and a plasticizer, depending on the fuel(s), oxidizer(s), and class 1.1 explosive(s) employed and the desired properties of the reactive material. Examples of energetic binders and nonenergetic binders that may be used include, but are not limited to, polyurethanes, epoxies, glycidyl azide polymer ("GAP"), silicone, polyesters, nylons, cellulose acetate butyrate ("CAB"), cellulose butyrate nitrate ("CBN"), ethyl cellulose, bisazidomethyloxetane ("BAMO"), and fluoropolymers. Examples of processing aids include, but are not limited to, silicone, graphite, and PTFE. The plasticizer may include, but is not limited to, (bis(2,2-dinitropropyl)-acetal/bis(2,2-dinitropropyl)formal) ("BDNPA/F"), glycidylazide plasticizer ("GAP"), and polyglycidyl nitrate ("PGN").

The reactive material may be formed by conventional techniques, such as by pressing, casting, or extruding. For instance, if the reactive material is an intermetallic-type, thermite-type composition, or class 1.1 explosive-type composition, the fuel, the oxidizer, the class 1.1 explosive, or any optional ingredients may be mixed, as known in the art. The reactive material may then be formed into a desired shape or may be loaded into the bullet or other projectile by conventional techniques, such as by casting, pressing, or extruding. In one embodiment, the reactive material includes THV, such as THV220 or THV500. If the reactive material includes THV, the reactive material may be easily formed, such as by hot pressing or extruding.

If the reactive material includes a fusible metal alloy, the reactive material may be formed by adding the oxidizer(s), the fuel(s), the class 1.1 explosive(s), or any optional ingredients, such as binders, plasticizers, or processing aids, to the fusible metal alloy to form a substantially homogenous mixture. The fusible metal alloy may be used in a liquid state, which is produced by heating the fusible metal alloy to a temperature above its melting point. As such, the fusible metal alloy may define a continuous phase and the remaining components may be dispersed therein. In other words, the fusible metal alloy may provide a metallic melt phase to which the remaining components are added. After mixing, the reactive material may be formed by conventional techniques. For instance, the reactive material may be placed into a mold or container having a desired shape. The reactive material including the fusible metal alloy may be melt-poured or may be granulated and then pressed. The reactive material may then be solidified to form the desired shape. The reactive material may also be formed by placing it in a mold and pressing into the desired shape.

When used in a reactive material projectile, the reactive material may generate at least one of a higher overpressure, earlier initiation, later initiation, greater damage at the target, and larger plume size and intensity than conventional fill materials, such as the fill material used in a MK211 projectile. If pressure release is a primary desired output of the reactive material projectile, the reactive material may be formulated to generate an overpressure of greater than approximately 9 pounds per square inch ("psi") at a radial measurement of 12 inches from the point of impact on a target. Alternatively, if target damage is the primary desired output, the reactive material projectile may be formulated to produce a hole in a target greater than approximately 2 square inches at an optimum penetration level. If initiation is the primary desired output, the reactive material may be formulated to provide pressure, damage, and a flame when the reactive material projectile impacts a target. By utilizing the reactive material of the present invention, the reactive material projectile may defeat a thin-skinned target. As used herein, the term "thin-skinned target" refers to a target having a thickness of less than about 0.25 inch. The thin-skinned target may be a vehicle, such as a car, aircraft, or watercraft. The thin-skinned target may also be an incoming missile or other projectile, a building, or a fuel storage container. For the sake of example only, a reactive material bullet according to the present invention may be used to defeat a fuel tank or fuel container, which typically has a wall thickness of at least 0.064 inch. The reactive material of the present invention may also be used, by way of example only, in a reactive material bullet that is capable of penetrating a thicker-skinned target, such as a target having a wall thickness of up to approximately ⅞-inch.

While the reactive material may be used as the fill material in a bullet, the reactive material may also be used in other munitions, such as in mortars or as a bombfill. For the sake of example only, the reactive material may be used in a projectile, such as the ballistic projectiles disclosed in U.S. Pat. No. 4,419,936 to Coates et al. The reactive material may also be used in a 0.50 caliber bullet. For instance, the reactive material may be used in a bullet that is designed to penetrate a thin-skinned target having a wall thickness of at least 0.064 inch. However, the reactive material may also be used in a bullet that is designed for greater penetration, such as into a thicker-skinned target having a wall thickness of up to approximately ⅞-inch. The reactive material may also be used as the fill material in other 0.50 caliber casings, such as in the MK211, M8, or M20 casings. The reactive material may also be used in medium caliber projectiles, such as, for example, in 35 mm, 30 mm, 25 mm and 20 mm cannon rounds, and in small caliber projectiles, such as, for example, in 0.223 caliber, 0.308 caliber, 0.45 caliber, and 9 mm bullets. The reactive material may also be used in larger caliber guns that provide direct or indirect fire.

An exemplary reactive material bullet 2 may have a case 4, a reactive material 8 disposed in a cavity 4*c* or chamber in the case, the mouth of the cavity 4*c* being closed by tip 6 at the forward end of the bullet 2, as schematically shown in FIG. 1. The cavity 4*c* in the reactive material bullet 2 may be larger than the chamber in a conventional incendiary bullet. The reactive material 8 may be loaded into a core of the reactive material bullet 2 by conventional techniques. For instance, the reactive material 8 may be pressed into the bullet core from the front of the case 4 at the mouth of cavity 4*c*. Alternatively, the reactive material 8 may be cast into a desired shape and placed in the case 4, or poured (cast) in a liquid state directly into the cavity 4*c*. Once the reactive material 8 is loaded into the case 4, the tip 6 may be inserted into the case 4 to complete fabrication of the reactive material bullet 2. Since the cavity 4*c* is larger than in a conventional incendiary bullet, the reactive material bullet 2 may utilize a larger volume of the reactive material 8 than conventional projectiles. For instance, the reactive material bullet 2 may utilize up to four times the volume of the reactive material 8 than is employed in the MK211 projectile.

When the reactive material bullet 2 is fired at a target, the mass and velocity of the reactive material bullet 2 may provide sufficient energy for the reactive material bullet 2 to penetrate the target. The material and configuration of the tip 6 may be selected in relation to the wall thickness of the intended target. The initial impact of the reactive material bullet 2 with the target may initiate or ignite the reactive material 8. As the tip 6 of the reactive material bullet 2 begins to penetrate the target, the tip 6 may be pushed back into the reactive material 8 and the shock of impact, as conveyed to the reactive material 8 by the tip 6, used to initiate the reactive material 8. If the target is, for example, a fuel tank or other container holding a volatile liquid, the impact may initiate reaction of the reactive material 8 as the tip 6 punctures the fuel tank, enabling fuel or other volatile liquid to escape and aerosolize in the atmosphere. As the reactive material bullet 2 continues to penetrate the target, the case 4 may be ruptured by the ongoing reaction of the reactive material 8, expelling hot, burning material into the vaporized fuel or other volatile liquid and igniting the fuel. Since the reactive material 8 may be initiated by the shock of impact of reactive material bullet 2 with the target, inclusion in reactive material bullet 2 of a separate initiation mechanism (such as a fuse or primer) for the reactive material 8 may not be necessary. While the reactive material 8 may be initiated on thin-skinned targets, such as targets having walls made of 1/16-inch steel, projectiles using reactive material 8 may also be used to penetrate thicker-skinned targets, such as those up to 7/8-inch steel wall thickness.

Although not required, the reactive material bullet 2 may optionally include a primer and a propellant to initiate the reactive material 8. Upon firing the reactive material bullet 2, the primer initiates the propellant, which in turn ignites the reactive material 8.

In one embodiment, the reactive material includes a mixture of 90% by weight ("wt %") Hf powder and 10 wt % THV220, which is designated as Formulation 1943-32-12. Formulation 1943-32-12 provides a large fireball/plume size when ignited and also provides extensive target damage. In another embodiment, the reactive material provides a high-pressure release and includes a mixture of PAX-2A (86.6% HMX, 8% BDNPA/F and 5.4% cellulose acetate butyrate) and Formulation 1943-37A (13.7% THV220 fluoropolymer, 27.45% aluminum powder, 44.56% potassium perchlorate, and 14.29% silicon). The reactive material included a mixture of 50% by volume PAX-2A and 50% by volume Formulation 1943-37A. A sandwich of this reactive material was formed by first pressing the PAX-2A and then pressing the Formulation 1943-37A on top of the pressed PAX-2A to give a reactive material having 30% by weight PAX-2A and 70% by weight Formulation 1943-37A.

The following examples serve to explain embodiments of the present invention in more detail. These examples are not to be construed as being exhaustive or exclusive as to the scope of this invention.

EXAMPLES

Example 1

Formulations of the Reactive Materials

Formulations of the reactive materials of the present invention are shown in Tables 1-3. Formulations of intermetallic and thermite compositions are shown in Table 1.

TABLE 1

Formulations of Intermetallic and Thermite Reactive Materials.

| Mix | Ingredient 1 | | Ingredient 2 | | Ingredient 3 | | Ingredient 4 | |
|---|---|---|---|---|---|---|---|---|
| Number | Name | Wt. % | Name | Wt. % | Name | Wt. % | Name | Wt. % |
| 1791-97-10 | Zr | 34.62 | CuO | 60.82 | VITON ® A | 5 | — | — |
| 1791-97-11 | Al | 17.52 | CuO | 77.48 | VITON ® A | 5 | — | — |
| STR: 22235 | Al-5μ | 44.2 | PTFE | 55.8 | — | — | — | — |
| STR: 22037 | Al-5μ | 28.3 | PTFE | 71.7 | — | — | — | — |
| STR: 22080 | Al-H95 | 28.3 | PTFE | 71.7 | — | — | — | — |
| 1836-90C | Phenolphthalein | 20.5 | $KNO_3$-15μ | 46.5 | $KClO_4$-9μ | 30 | PVA | 3 |
| 1836-90D | Phenolphthalein | 15.6 | KNO3-15μ | 51.4 | $KClO_4$-9μ | 30 | PVA | 3 |
| STR: 22610 | $SrNO_3$ | 66.54 | Mg | 31.71 | Nylon | 1.75 | — | — |
| 1791-100-1 | W-690 nm | 82.2 | KP-5μ | 10.3 | VITON ® A | 7.5 | — | — |
| 1791-100-2 | W-690 nm | 72.2 | KP-5μ | 20.3 | VITON ® A | 7.5 | — | — |
| 1943-77A | Nano-Al | 26 | PTFE | 74 | — | — | — | — |
| 2002-1-1 | Zr | 47.7 | PTFE | 52.3 | — | — | — | — |
| 1943-77B | Nano-Al | 27 | $MoO_3$ | 23 | PTFE | 50 | — | — |
| 1943-77D | Zn | 56.75 | PTFE | 43.25 | — | — | — | — |
| 1661-60A | Magnalium | 24.5 | BCN-12.5μ | 68.5 | Ethyl Cellulose | 7 | — | — |
| 1661-60D | Al | 27.5 | BCN-12.5μ | 68.1 | Ethyl Cellulose | 4.5 | — | — |
| 1775-50A | HACN | 79 | BCN-12.5μ | 18 | $Fe_2O_3$ | 3 | — | — |
| 1791-97-1 | Al-H5 | 52.74 | Boron | 42.26 | VITON ® A | 5 | — | — |
| 1791-97-2 | Al-H5 | 50.33 | Titanium | 44.67 | VITON ® A | 5 | — | — |
| 1791-97-3 | Al-H5 | 35.31 | Zirconium | 59.69 | VITON ® A | 5 | — | — |
| 1791-97-4 | Titanium | 65.45 | Boron | 29.55 | VITON ® A | 5 | — | — |
| 1791-97-5 | Zirconium | 76.8 | Boron | 18.2 | VITON ® A | 5 | — | — |
| 1791-97-7 | Hafnium | 84.74 | Boron | 10.26 | VITON ® A | 5 | — | — |
| 1791-97-8 | Mg (−325 mesh) | 22.23 | CuO | 72.77 | VITON ® A | 5 | — | — |
| 1791-97-9 | Titanium | 21.98 | CuO | 72.02 | VITON ® A | 5 | — | — |
| 1791-97-12 | Hf | 50.23 | CuO | 44.77 | VITON ® A | 5 | — | — |
| 1943-26D | Al-H5 | 50 | KP-100μ | 10 | THV220 | 40 | — | — |
| 1943-26F | Zr | 65 | THV220 | 35 | — | — | — | — |
| 1943-26E | Hf | 90 | THV220 | 10 | — | — | — | — |
| 1943-37A | Al | 27.45 | THV220 | 13.7 | KP | 44.56 | Si | 14.29 |
| 1943-32-03 | Al-H5 | 35.31 | Zr | 59.69 | VITON ® A | 5 | | |
| 1943-32-07 | Mg (−325 mesh) | 22.23 | CuO | 72.77 | VITON ® A | 5 | | |
| 1943-32-01 | Al-H5 | 52.74 | Boron | 42.26 | VITON ® A | 5 | | |

Al-H95 = spherical aluminum having a particle size of approximately 95 microns

Al-H5 = spherical aluminum having a particle size of approximately 5 microns

Nano-Al = aluminum having a particle size of approximately 5 microns

Formulations of class 1.1 explosive compositions are shown in Table 2.

TABLE 2

Formulations of Class 1.1 Reactive Materials.

| Mix | Ingredient 1 | | Ingredient 2 | | Ingredient 3 | | Ingredient 4 | |
|---|---|---|---|---|---|---|---|---|
| Number | Name | Wt. % | Name | Wt. % | Name | Wt. % | Name | Wt. % |
| PAX-2A | HMX | 85 | CAB | 6 | BDNPA/F | 9 | — | — |
| PAX-22a - 1855-70 | CL-20 | 92 | CAB | 3.2 | BDNPA/F | 4.8 | — | — |
| Form 10 - 1855-66 | CL-20 | 92 | CBN | 3.2 | BDNPA/F | 4.8 | — | — |
| PAX-11c - 1943-02 | CL-20 | 94 | CAB | 0.58 | BDNPA/F | 5.18 | Graphite | 0.24 |
| PAX-11c - 1943-15 | CL-20 | 94 | BAMO-PGN | 3 | BDNPA/F | 3 | — | — |
| Form 9 - 1855-53 | CL-20 | 94 | CBN | 2.4 | BDNPA/F | 3.6 | — | — |
| 1943-03H | IND 174 | 14.25 | KP-100μ | 80.9 | CAB | 0.6 | BDNPA/F | 4 |
| 1943-03I | IND 174 | 14.25 | AP-100μ | 80.9 | CAB | 0.6 | BDNPA/F | 4 |
| 1943-03F | IND 174 | 18.45 | RDX-100μ | 81.95 | CAB | 0.55 | BDNPA/F | 3.75 |
| 1943-04G | IND 174 | 20 | CL-20-100μ | 69.75 | CAB | 1 | BDNPA/F | 9 |
| 1943-03E | IND 174 | 21.43 | AP-100μ | 71.43 | CBN | 0.89 | BDNPA/F | 5.89 |
| 1943-03J | IND 174 | 24.25 | KP-100μ | 33.75 | RDX-100μ | 33.75 | CAB | 1 |
| 1943-04F | IND 174 | 25 | KP-100μ | 27.75 | RDX-100μ | 27.75 | Mg −325 | 10 |
| 1943-04F-B | IND 174 | 25 | KP-100μ | 27.75 | RDX-100μ | 27.75 | Mg −325 | 10 |
| 1943-04B | IND 174 | 66.67 | KP-100μ | 14.28 | RDX-100μ | 14.28 | CBN | 0.57 |
| 1943-04A | IND 174 | 67.6 | KP-100μ | 14.45 | RDX-100μ | 14.45 | CAB | 0.43 |
| 1943-32-17 | IND 174 | 54.3 | KP-100μ | 18.1 | TNT | 18.1 | CAB | 1.5 |

| Mix | Ingredient 5 | | Ingredient 6 | | Ingredient 7 | |
|---|---|---|---|---|---|---|
| Number | Name | Wt. % | Name | Wt. % | Name | Wt. % |
| PAX-2A | — | — | — | — | — | — |
| PAX-22a -1855-70 | — | — | — | — | — | — |
| Form 10 -1855-66 | — | — | — | — | — | — |
| PAX-11c -1943-02 | — | — | — | — | — | — |
| PAX-11c -1943-15 | — | — | — | — | — | — |
| Form 9 -1855-53 | — | — | — | — | — | — |
| 1943-03H | Graphite | 0.3 | — | — | — | — |
| 1943-03I | Graphite | 0.3 | — | — | — | — |
| 1943-03F | Graphite | 0.25 | — | — | — | — |
| 1943-04G | Graphite | 0.25 | — | — | — | — |
| 1943-03E | Graphite | 0.36 | — | — | — | — |
| 1943-03J | BDNPA/F | 6.75 | Graphite | 0.5 | — | — |
| 1943-04F | CAB | 1.5 | BDNPA/F | 7.75 | Graphite | 0.25 |
| 1943-04F-B | CAB | 1.5 | BDNPA/F | 7.75 | Graphite | 0.25 |
| 1943-04B | BDNPA/F | 3.92 | Graphite | 0.28 | — | — |
| 1943-04A | BDNPA/F | 2.89 | Graphite | 0.22 | — | — |
| 1943-32-17 | BDNPA/F | 7.75 | Graphite | 0.25 | — | — |

Formulations of INDALLOY®-containing compositions are shown in Table 3.

TABLE 3

Formulations of INDALLOY ®-containing Reactive Materials.

| Mix | Ingredient 1 | | Ingredient 2 | | Ingredient 3 | | Ingredient 4 | |
|---|---|---|---|---|---|---|---|---|
| Number | Name | Wt. % | Name | Wt. % | Name | Wt. % | Name | Wt. % |
| 1943-32-13 | IND 174 | 14.25 | KP-100μ | 80.9 | CAB | 0.6 | BDNPA/F | 4 |
| 1943-03H | IND 174 | 14.25 | KP-100μ | 80.9 | CAB | 0.6 | BDNPA/F | 4 |
| 1943-03I | IND 174 | 14.25 | AP-100μ | 80.9 | CAB | 0.6 | BDNPA/F | 4 |
| 1943-03D | IND 174 | 16.67 | KP-100μ | 77.78 | CBN | 0.68 | BDNPA/F | 4.58 |
| 1943-03B | IND 174 | 18.18 | RDX-100μ | 75.76 | CBN | 0.76 | BDNPA/F | 5 |
| 1943-03F | IND 174 | 18.45 | RDX-100μ | 81.95 | CAB | 0.55 | BDNPA/F | 3.75 |
| 1943-04G | IND 174 | 20 | CL-20-100μ | 69.75 | CAB | 1 | BDNPA/F | 9 |
| 1943-04H | IND 174 | 20 | CL-20-100μ | 55 | Mg −325 | 14.75 | CAB | 1 |
| 1943-03G | IND 174 | 20.2 | CL-20-100μ | 72.9 | CAB | 0.85 | BDNPA/F | 5.65 |
| 1943-03E | IND 174 | 21.43 | AP-100μ | 71.43 | CBN | 0.89 | BDNPA/F | 5.89 |
| 1943-03J | IND 174 | 24.25 | KP-100μ | 33.75 | RDX-100μ | 33.75 | CAB | 1 |
| 1943-32-14 | IND 174 | 24.25 | KP-100μ | 33.75 | RDX-100μ | 33.75 | CAB | 1 |

TABLE 3-continued

Formulations of INDALLOY ®-containing Reactive Materials.

| | | | | | | | | |
|---|---|---|---|---|---|---|---|---|
| 1943-04F | IND 174 | 25 | KP-100μ | 27.75 | RDX-100μ | 27.75 | Mg −325 | 10 |
| 1943-04F-B | IND 174 | 25 | KP-100μ | 27.75 | RDX-100μ | 27.75 | Mg −325 | 10 |
| 1943-03C | IND 174 | 26.09 | CL-20-100μ | 65.22 | CBN | 1.09 | BDNPA/F | 7.17 |
| 1943-03K | IND 174 | 29.6 | KP-100μ | 30.2 | RDX-100μ | 30.2 | CBN | 1.2 |
| 1943-34A | IND 174 | 50 | KP-100μ | 30 | CAB | 2 | BDNPA/F | 18 |
| 1943-34B | IND 174 | 54 | KP-100μ | 36 | BAMO-PGN | 1 | BDNPA/F | 9 |
| 1943-34C | IND 174 | 54 | KP-100μ | 36 | BAMO-GAP | 1 | BDNPA/F | 9 |
| 1943-04C | IND 174 | 56.85 | KP-100μ | 37.9 | CAB | 1 | BDNPA/F | 4 |
| 1943-04C-B | IND 174 | 56.85 | KP-100μ | 37.9 | CAB | 1 | BDNPA/F | 4 |
| 1943-34D | IND 174 | 60 | KP-5μ | 40 | — | — | — | — |
| 1943-04B | IND 174 | 66.67 | KP-100μ | 14.28 | RDX-100μ | 14.28 | CBN | 0.57 |
| 1943-04A | IND 174 | 67.6 | KP-100μ | 14.45 | RDX-100μ | 14.45 | CAB | 0.43 |
| 1943-04D | IND 174 | 75.8 | KP-100μ | 18.95 | CAB | 1 | BDNPA/F | 4 |
| 1943-04D-B | IND 174 | 75.8 | KP-100μ | 18.95 | CAB | 1 | BDNPA/F | 4 |
| 1943-34E | IND 174 | 80 | KP-5μ | 20 | — | — | — | — |
| 1943-04E | IND 174 | 85.28 | KP-100μ | 9.48 | CAB | 1 | BDNPA/F | 4 |
| 1943-04E-B | IND 174 | 85.28 | KP-100μ | 9.48 | CAB | 1 | BDNPA/F | 4 |
| 1943-32-17 | IND 174 | 54.3 | KP-100μ | 18.1 | TNT | 18.1 | CAB | 1.5 |
| 1943-37B | IND 174 | 15 | KP-100μ | 46 | Al-H5 | 15 | Si | 8 |

| Mix | Ingredient 5 | | Ingredient 6 | | Ingredient 7 | |
|---|---|---|---|---|---|---|
| Number | Name | Wt. % | Name | Wt. % | Name | Wt. % |
| 1943-32-13 | Graphite | 0.3 | | | | |
| 1943-03H | Graphite | 0.3 | — | — | — | — |
| 1943-03I | Graphite | 0.3 | — | — | — | — |
| 1943-03D | Graphite | 0.28 | — | — | — | — |
| 1943-03B | Graphite | 0.3 | — | — | — | — |
| 1943-03F | Graphite | 0.25 | — | — | — | — |
| 1943-04G | Graphite | 0.25 | — | — | — | — |
| 1943-04H | BDNPA/F | 9 | Graphite | 0.25 | — | — |
| 1943-03G | Graphite | 0.4 | — | — | — | — |
| 1943-03E | Graphite | 0.36 | — | — | — | — |
| 1943-03J | BDNPA/F | 6.75 | Graphite | 0.5 | — | — |
| 1943-32-14 | BDNPA/F | 6.75 | Graphite | 0.5 | | |
| 1943-04F | CAB | 1.5 | BDNPA/F | 7.75 | Graphite | 0.25 |
| 1943-04F-B | CAB | 1.5 | BDNPA/F | 7.75 | Graphite | 0.25 |
| 1943-03C | Graphite | 0.43 | — | — | — | — |
| 1943-03K | BDNPA/F | 8.3 | Graphite | 0.6 | — | — |
| 1943-34A | — | — | — | — | — | — |
| 1943-34B | — | — | — | — | — | — |
| 1943-34C | — | — | — | — | — | — |
| 1943-04C | Graphite | 0.25 | — | — | — | — |
| 1943-04C-B | Graphite | 0.25 | — | — | — | — |
| 1943-34D | — | — | — | — | — | — |
| 1943-04B | BDNPA/F | 3.92 | Graphite | 0.28 | — | — |
| 1943-04A | BDNPA/F | 2.89 | Graphite | 0.22 | — | — |
| 1943-04D | Graphite | 0.25 | — | — | — | — |
| 1943-04D-B | Graphite | 0.25 | — | — | — | — |
| 1943-34E | — | — | — | — | — | — |
| 1943-04E | Graphite | 0.25 | — | — | — | — |
| 1943-04E-B | Graphite | 0.25 | — | — | — | — |
| 1943-32-17 | BDNPA/F | 7.75 | Graphite | 0.25 | — | — |
| 1943-37B | S | 6 | BAMO-GAP | 1 | BDNPA/F | 9 |

IND 174 = Indalloy ® 174

Each of the formulations was prepared by adding the ingredients to a mixer and mixing the ingredients to obtain a homogenous mixture.

Example 2

Safety Testing of the Reactive Material Formulations

Safety testing was performed on the reactive material formulations described in Example 1. Friction properties of the formulations were measured using a friction test developed by Allegheny Ballistics Laboratory ("ABL"). Onset of ignition exotherms and sensitivity to elevated temperatures of the formulations were measured using a Simulated Bulk Autoignition Test ("SBAT"). Electrostatic discharge ("ESD") of the formulations was measured using an ESD test developed by Thiokol Corporation ("TC"). Impact properties of the formulations were measured using an impact test developed by TC and an impact test developed by ABL. Deflagration to detonation ("DDT") transitions of the formulations was also measured. These tests are known in the art and, therefore, details of these tests are not included herein. The safety properties were used to determine whether the reactive materials had a low level of sensitivity (green line ("GL")), an intermediate level of sensitivity (yellow line ("YL")), or a high level of sensitivity (red line ("RL")). The overall rating assigned to each of the reactive materials is the lowest (most conservative) rating received from the safety tests.

Safety results for the formulations described in Example 1 are shown in Tables 4-6.

TABLE 4

Safety Results for the Intermetallic and Thermite Reactive Materials.

| Mix No. | ABL Friction (lbs @ fps) | SBAT Onset (° F.) | TC FSD Unc. (J) | TC Impact (in.) | ABL Impact (cm) | Russian DDT (@500 psi) |
|---|---|---|---|---|---|---|
| 1791-97-10 | <25 @ 2 (RL) | 368 (GL) | <0.05 (RL) | >46 | 80 | NT |
| 1791-97-11 | <25 @ 2 (RL) | 362 (GL) | <0.05 (RL) | >46 | 80 | NT |
| STR: 22235 | 800 @ 8 (GL) | >500 (GL) | 4.5 (YL) | >46 | 21 (GL) | NT |
| STR: 22037 | 800 @ 8 (GL) | >500 (GL) | 6.75 (GL) | 45 (GL) | 21 (GL) | NT |
| STR: 22080 | 800 @ 8 (GL) | >500 (GL) | >8 | >46 | 80 (GL) | NT |
| 1836-90C | 800 @ 8 (GL) | 482 (GL) | >8 | 42.11 (GL) | NT | No Go |
| 1836-90D | 800 @ 8 (GL) | 481 (GL) | >8 | 41.5 (GL) | NT | No Go |
| STR: 22610 | 50 @ 8 (YL) | >500 (GL) | >8 | >46 | 6.9 (GL) | NT |
| 1791-100-1 | 130 @ 4 (YL) | 425 (GL) | 0.65 (YL) | >46 | 3.5 (YL) | NT |
| 1791-100-2 | 25 @ 6 (YL) | 441 (GL) | <0.05 (YL) | >46 | 1.8 (RL) | NT |
| 1943-77A | 800 @ 8 (GL) | >500 | <0.05 (RL) | >46 | NT | NT |
| 2002-1-1 | 800 @ 8 (GL) | >500 | <0.05 (YL) | >46 | NT | NT |
| 1943-77B | 660 @ 4 (YL) | >500 | <0.05 (RL) | 45 | NT | NT |
| 1943-77D | 800 @ 8 (GL) | >500 | >8 | >46 | NT | NT |
| 1661-60A | 100 @ 4 (YL) | 357 (GL) | >8 | >46 | NT | No Go |
| 1661-60D | 100 @ 6 (GL) | 338 (GL) | >8 | >46 | NT | No Go |
| 1775-50A | 800 @ 8 (GL) | 349 (GL) | >8 | >46 | NT | No Go |
| 1791-97-1 | 800 @ 8 (GL) | >500 | 0.65 (YL) | >46 | 80 (GL) | NT |
| 1791-97-2 | 800 @ 8 (GL) | >500 | <0.05 (YL) | >46 | 80 (GL) | NT |
| 1791-97-3 | 800 @ 8 (GL) | 458 (GL) | <0.05 (YL) | >46 | 80 (GL) | NT |
| 1791-97-4 | 130 @ 4 (YL) | 440 (GL) | <0.05 (RL) | >46 | 80 (GL) | NT |
| 1791-97-5 | 240 @ 4 (YL) | 410 (GL) | <0.05 (RL) | >46 | 80 (GL) | NT |
| 1791-97-7 | 240 @ 4 (YL) | >500 | <0.05 (YL) | >46 | 80 (GL) | NT |
| 1791-97-8 | 100 @ 3 (YL) | 391 (GL) | <0.05 (RL) | >46 | 64 (GL) | NT |
| 1791-97-9 | 130 @ 3 (YL) | 425 (GL) | <0.05 (YL) | >46 | 80 (GL) | NT |
| 1791-97-12 | 180 @ 8 (GL) | 447 (GL) | <0.05 (RL) | >46 | 80 (GL) | NT |
| 1943-26D | 100 @ 8 (GL) | >500 | >8 | 43.29 (GL) | 1.8 (RL) | NT |
| 1943-26F | 800 @ 8 (GL) | >500 | <0.05 (YL) | 44 (GL) | 13 (GL) | NT |
| 1943-26E | 800 @ 8 (GL) | >500 | <0.05 (YL) | >46 | 21 (GL) | NT |
| 1943-37A | 240 @ 8 (GL) | 276 (YL) | 6.9 (YL) | 44 | 6.9 (GL) | NT |

TABLE 5

Safety Results for the Class 1.1 Reactive Materials.

| Mix No. | ABL Friction (lbs @ fps) | SBAT Onset (° F.) | TC ESD Unc. (J) | TC Impact (in.) | ABL Impact (cm) | Russian DDT (@500 psi) |
|---|---|---|---|---|---|---|
| PAX-2A | 560 @ 8 (GL) | 360 (GL) | >8 | 41.67 (GL) | 64 (GL) | Go |
| PAX-22a - 1855-70 | 240 @ 8 (GL) | 319 (GL) | >8 | 23.50 (GL) | 13 (GL) | Go |
| Form 10 - 1855-66 | 100 @ 8 (GL) | 326 (GL) | >8 | NT | 6.9 (GL) | Go |
| PAX-11c - 1943-02 | 130 @ 8 (GL) | 330 (GL) | >8 | NT | 6.9 (GL) | Go |
| PAX-11c - 1943-15 | 240 @ 8 (GL) | 301 (GL) | >8 | 21.5 (GL) | 13 (GL) | Go |
| Form 9 - 1855-53 | 240 @ 8 (GL) | 313 (GL) | >8 | NT | 6.9 (GL) | Go |
| 1943-03H | 800 @ 8 (GL) | 371 (GL) | >8 (GL) | 18.67 (GL) | 1.8 (RL) | Go, 9.8" Run |
| 1943-03I | 800 @ 8 (GL) | 409 (GL) | >8 (GL) | 13.0 (GL) | 3.5 (YL) | Go, 5.7" Run |
| 1943-03F | 800 @ 8 (GL) | 350 (GL) | 7.5 (YL) | 18.45 (GL) | 6.9 (GL) | Go, 3.2" Run |
| 1943-04G | 25 @ 6 (YL) | 310 (GL) | >8 (GL) | 19.9 (GL) | 3.5 (YL) | NT |
| 1943-03E | 800 @ 8 (GL) | 287 (YL) | >8 (GL) | 11.14 (GL) | 1.1 (RL) | Go, 7.2" Run |
| 1943-03J | 800 @ 8 (GL) | 336 (GL) | >8 (GL) | 15.55 (GL) | 1.8 (RL) | Go, 5.4" Run |
| 1943-04F | 25 @ 4 (YL) | 336 (GL) | >8 (GL) | 18.64 (GL) | 1.8 (RL) | NT |
| 1943-04F-B | 25 @ 4 (YL) | 345 (GL) | 7.8 (YL) | 22.40 (GL) | 3.5 (YL) | NT |
| 1943-04B | 25 @ 3 (RL) | 301 (GL) | >8 (GL) | 10.4 (YL) | 1.8 (RL) | NT |
| 1943-04A | <25 @ 2 (RL) | 308 (GL) | 7.5 (YL) | 13.91 (GL) | 1.1 (RL) | NT |
| 1943-32-17 | 800 @ 8 (GL) | 319 (GL) | 1.59 (YL) | 5.96 (YL) | 1.8 (RL) | NT |

TABLE 6

Safety Results for the INDALLOY ®-containing Reactive Materials.

| Mix No. | ABL Friction (lbs @ fps) | SBAT Onset (° F.) | TC ESD Unc. (J) | TC Impact (in.) | ABL Impact (cm) | Russian DDT (@500 psi) |
|---|---|---|---|---|---|---|
| 1943-03H | 800 @ 8 (GL) | 371 (GL) | >8 (GL) | 18.67 (GL) | 1.8 (RL) | Go, 9.8" Run |
| 1943-03I | 800 @ 8 (GL) | 409 (GL) | >8 (GL) | 13.0 (GL) | 3.5 (YL) | Go, 5.7" Run |
| 1943-03D | 800 @ 8 (GL) | 287 (YL) | >8 (GL) | 18.80 (GL) | 1.8 (RL) | No Go |
| 1943-03B | 800 @ 8 (GL) | 287 (YL) | >8 (GL) | 21.55 (GL) | 6.9 (GL) | Go, 5.9" Run |
| 1943-03F | 800 @ 8 (GL) | 350 (GL) | 7.5 (YL) | 18.45 (GL) | 6.9 (GL) | Go, 3.2" Run |
| 1943-04G | 25 @ 6 (YL) | 310 (GL) | >8 (GL) | 19.9 (GL) | 3.5 (YL) | NT |
| 1943-04H | 25 @ 2 (RL) | 345 (GL) | 7.25 (YL) | 16.82 (GL) | <1.1 (RL) | NT |
| 1943-03G | 800 @ 8 (GL) | 316 (GL) | >8 (GL) | 16.0 (GL) | 1.8 (RL) | Go, 0.0" Run |
| 1943-03E | 800 @ 8 (GL) | 287 (YL) | >8 (GL) | 11.14 (GL) | 1.1 (RL) | Go, 7.2" Run |
| 1943-03J | 800 @ 8 (GL) | 336 (GL) | >8 (GL) | 15.55 (GL) | 1.8 (RL) | Go, 5.4" Run |
| 1943-04F | 25 @ 4 (YL) | 336 (GL) | >8 (GL) | 18.64 (GL) | 1.8 (RL) | NT |
| 1943-04F-B | 25 @ 4 (YL) | 345 (GL) | 7.8 (YL) | 22.40 (GL) | 3.5 (YL) | NT |
| 1943-03C | 800 @ 8 (GL) | 287 (YL) | >8 (GL) | 13.17 (GL) | 1.8 (RL) | Go, 2.8" Run |
| 1943-03K | 800 @ 8 (GL) | 292 (YL) | 7.30 (YL) | 13.17 (GL) | 3.5 (YL) | Go, 5.3" Run |
| 1943-34A | 50 @ 4 (YL) | 334 (GL) | >8 (GL) | 9.25 (YL) | 1.8 (RL) | NT |
| 1943-34B | 25 @ 3 (RL) | 315 (GL) | >8 (GL) | 8.0 (YL) | 1.8 (RL) | NT |
| 1943-34C | 25 @ 4 (YL) | 336 (GL) | >8 | 8.7 (YL) | 3.5 (YL) | NT |
| 1943-04C | 25 @ 4 (YL) | 331 (GL) | >8 (GL) | 16.33 (GL) | 3.5 (YL) | NT |
| 1943-04C-B | 25 @ 4 (YL) | 376 (GL) | >8 (GL) | 18.64 (GL) | 3.5 (YL) | NT |
| 1943-34D | 560 @ 8 (GL) | 324 (GL) | >8 | 39.8 (GL) | 11 (GL) | NT |
| 1943-04B | 25 @ 3 (RL) | 301 (GL) | >8 (GL) | 10.4 (YL) | 1.8 (RL) | NT |
| 1943-04A | <25 @ 2 (RL) | 308 (GL) | 7.5 (YL) | 13.91 (GL) | 1.1 (RL) | NT |
| 1943-04D | 50 @ 3 (YL) | 317 (GL) | >8 (GL) | 14.33 (GL) | 3.5 (YL) | NT |
| 1943-04D-B | 50 @ 3 (YL) | 321 (GL) | 1.70 (YL) | 13.00 (GL) | 1.8 (RL) | NT |
| 1943-34E | 660 @ 8 (GL) | 317 (GL) | 7.50 (YL) | 30.45 (GL) | 6.9 (GL) | NT |
| 1943-04E | 50 @ 4 (YL) | 309 (GL) | >8 (GL) | 43.86 (GL) | 3.5 (YL) | NT |
| 1943-04E-B | 25 @ 4 (YL) | 326 (GL) | >8 (GL) | 8.23 (YL) | 1.8 (RL) | NT |
| 1943-32-17 | 800 @ 8 (GL) | 319 (GL) | 1.59 (YL) | 5.96 (YL) | 1.8 (RL) | NT |
| 1943-37B | 50 @ 4 (YL) | 328 (GL) | 7.50 (YL) | 14 (GL) | 1.8 (RL) | NT |

Formulations having sufficient safety and sensitivity properties were selected for testing in reactive material bullets. Formulations that initiated on the Russian DDT test were not evaluated in reactive material bullets due to safety concerns.

Example 3

Reactive Material Bullets Including the Reactive Material Formulations

Twenty-four formulations were loaded into a reactive material bullet by pressing the reactive material into the core of the bullet case from the front. In addition to the formulations shown in Tables 7 and 8, Formulations 1943-32-02, 1943-32-04, 1943-32-05, 1943-32-06, 1943-32-08, 1943-32-09, 1943-32-10, 1943-32-17, and 1791-100-1 were also tested. The tip was then inserted into the case to form the reactive material bullet. The formulations were tested in a reactive material bullet designed to penetrate a thin-skinned target, referred to herein as the bullet for thin-skinned targets, or in a reactive material bullet having increased penetration and designed to penetrate a thicker-skinned target, referred to herein as the bullet for thicker-skinned targets.

Figure 2:
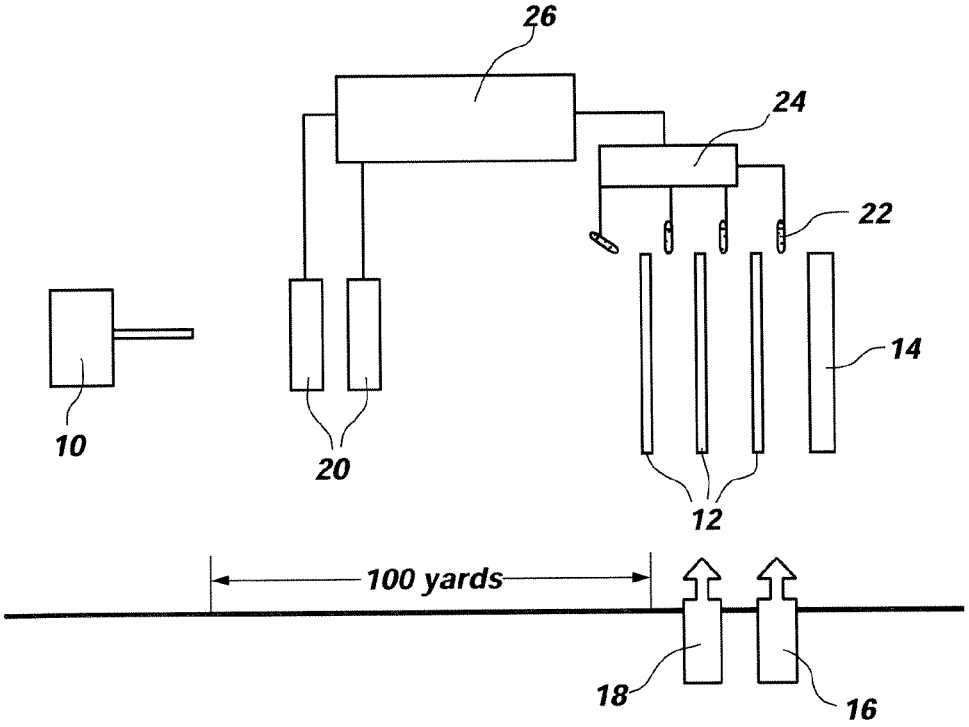
FIG. 2 is a schematic illustration of a hundred-yard test range used to test reactive material bullets including reactive materials of the present invention.
Figure 3:
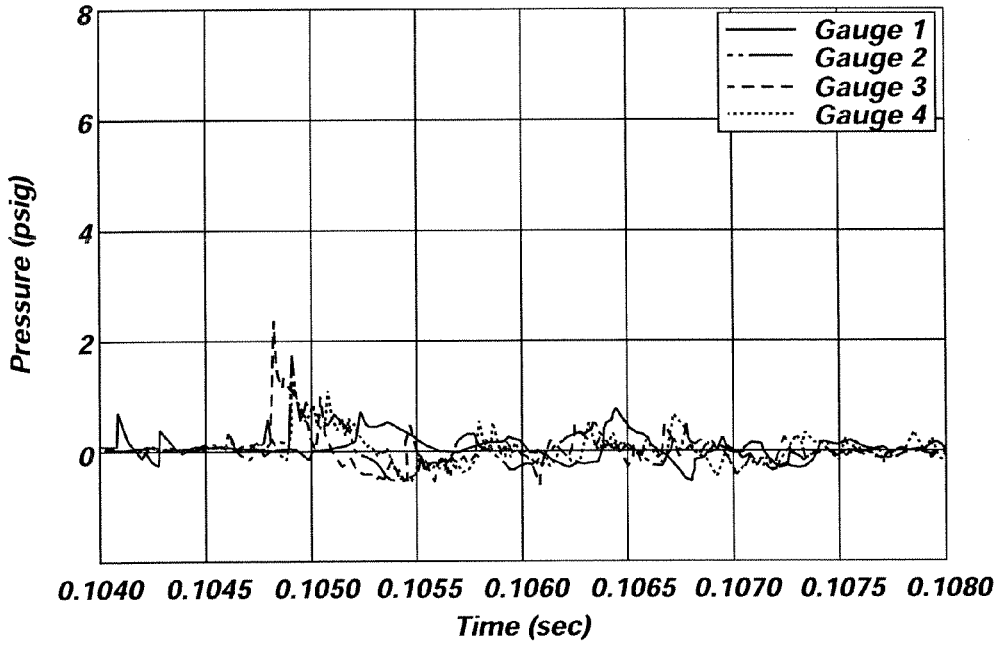
FIGS. 3-14 are pressure-versus-time profiles for reactive material bullets including reactive materials of the present invention.
Figure 4:
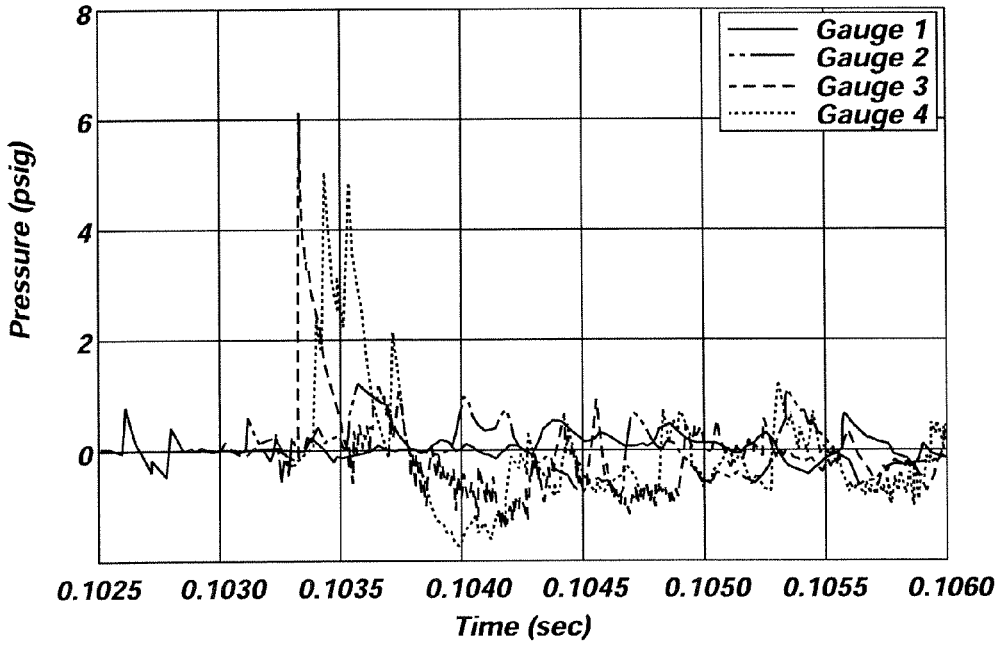
Figure 5:
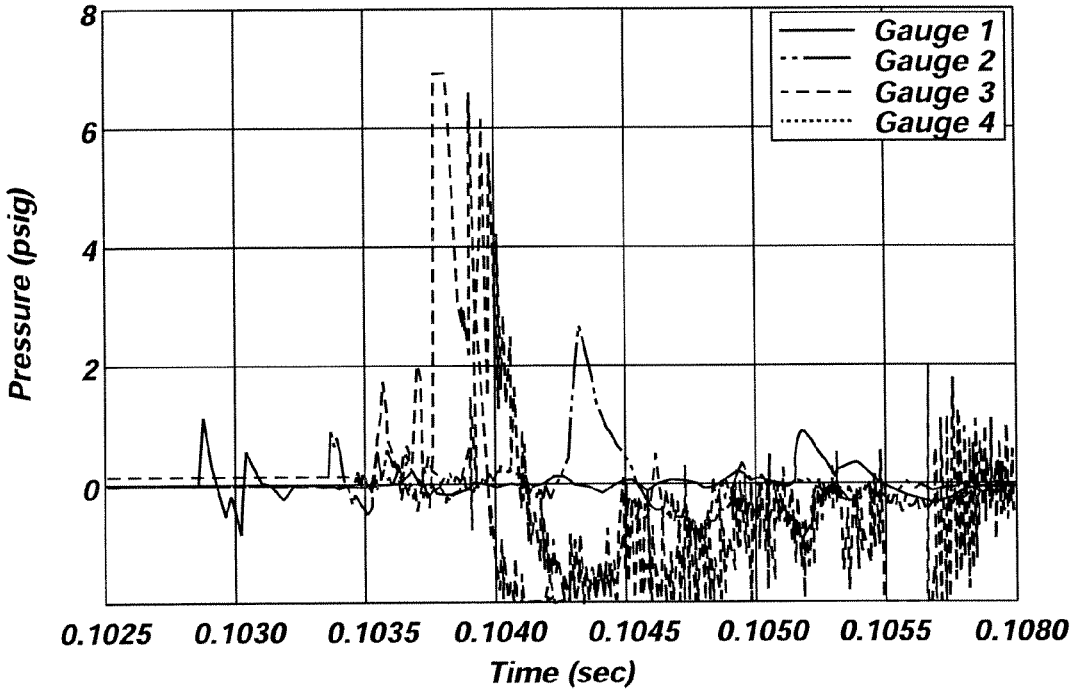
Figure 6:
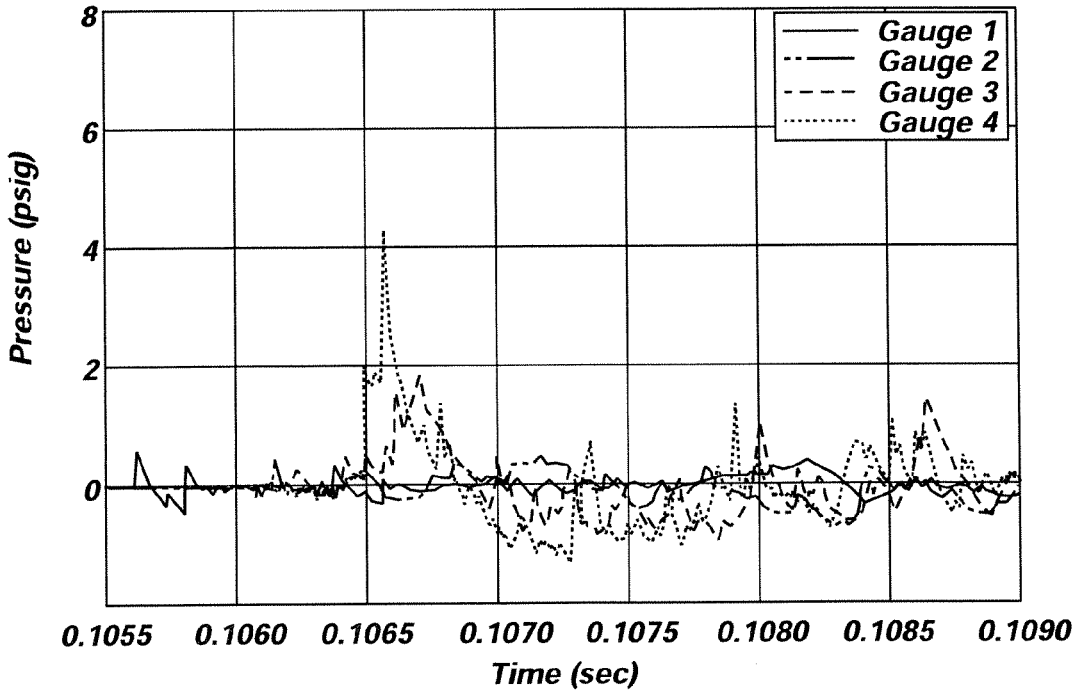
Figure 7:
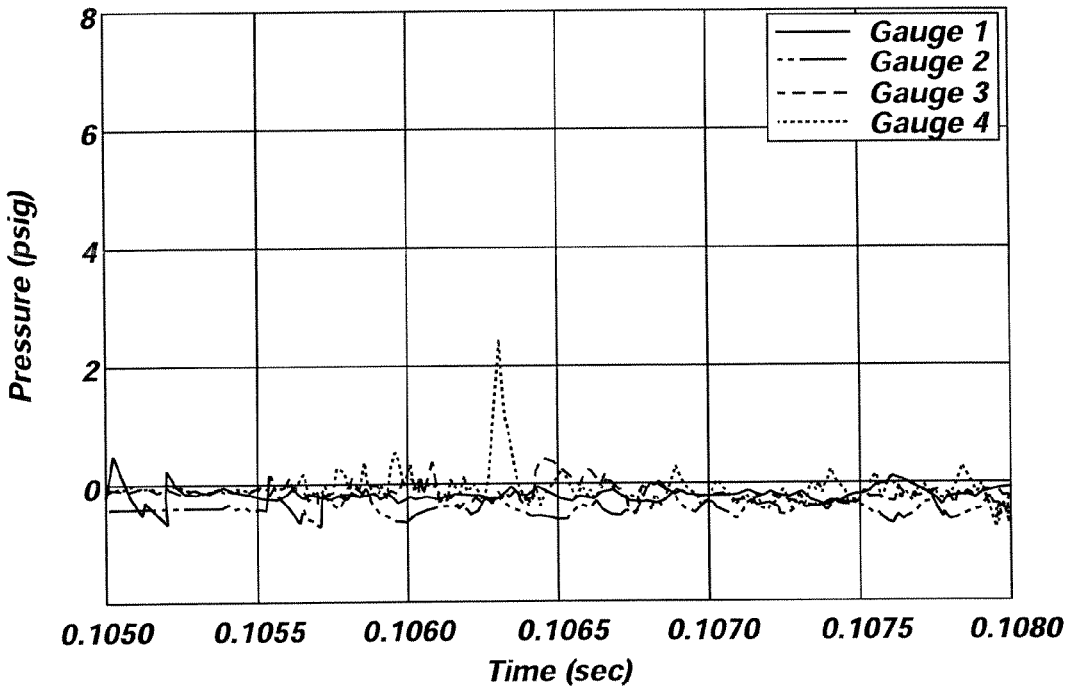
Figure 8:
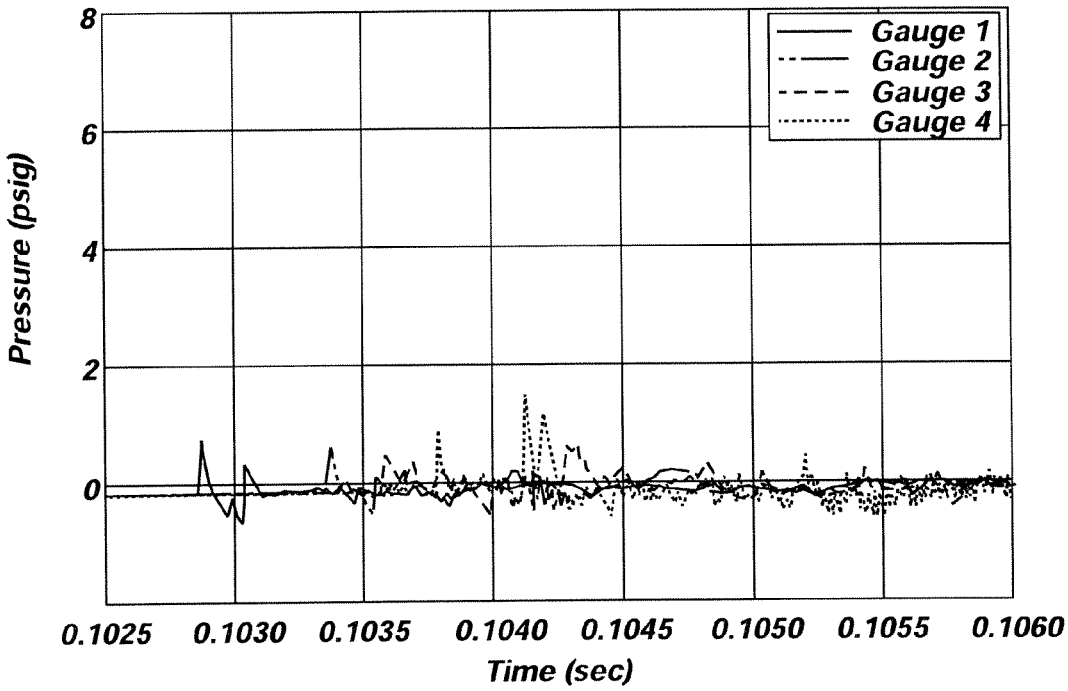
Figure 9:
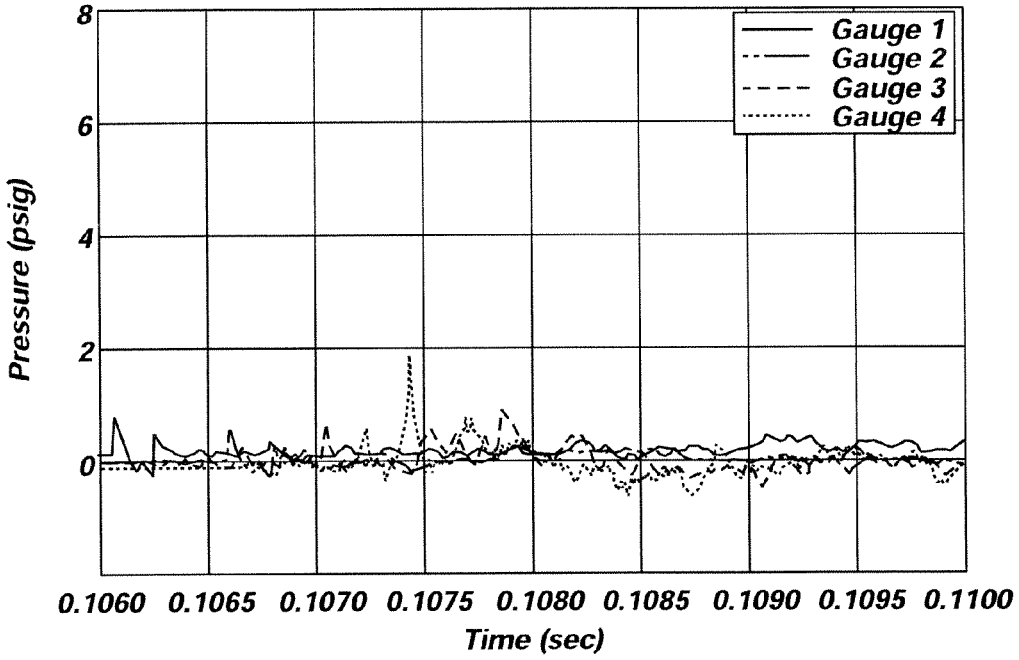
Figure 10:
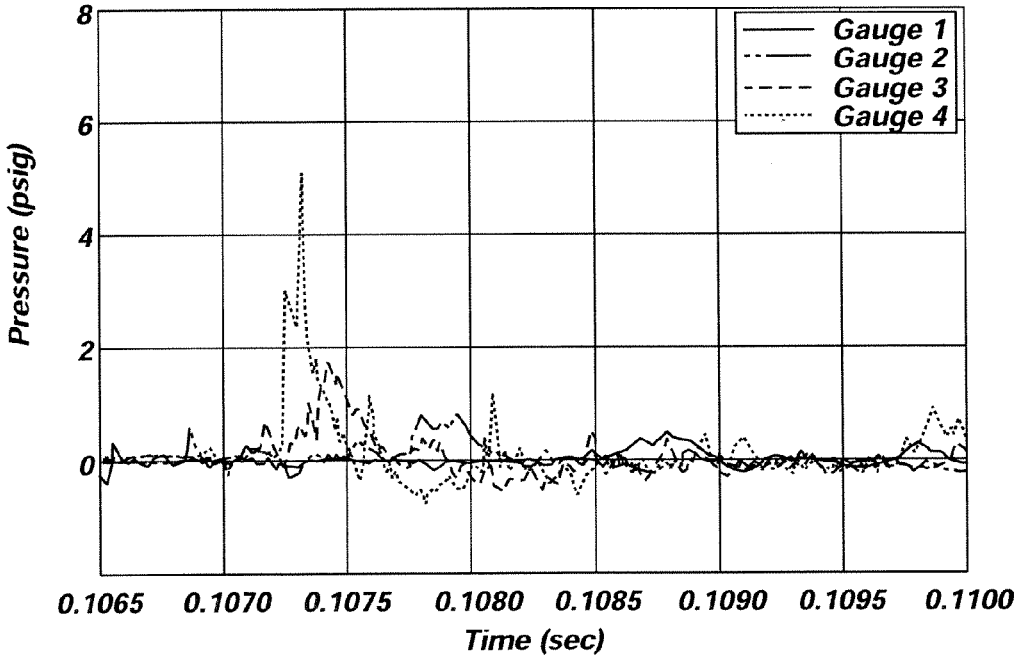
Figure 11:
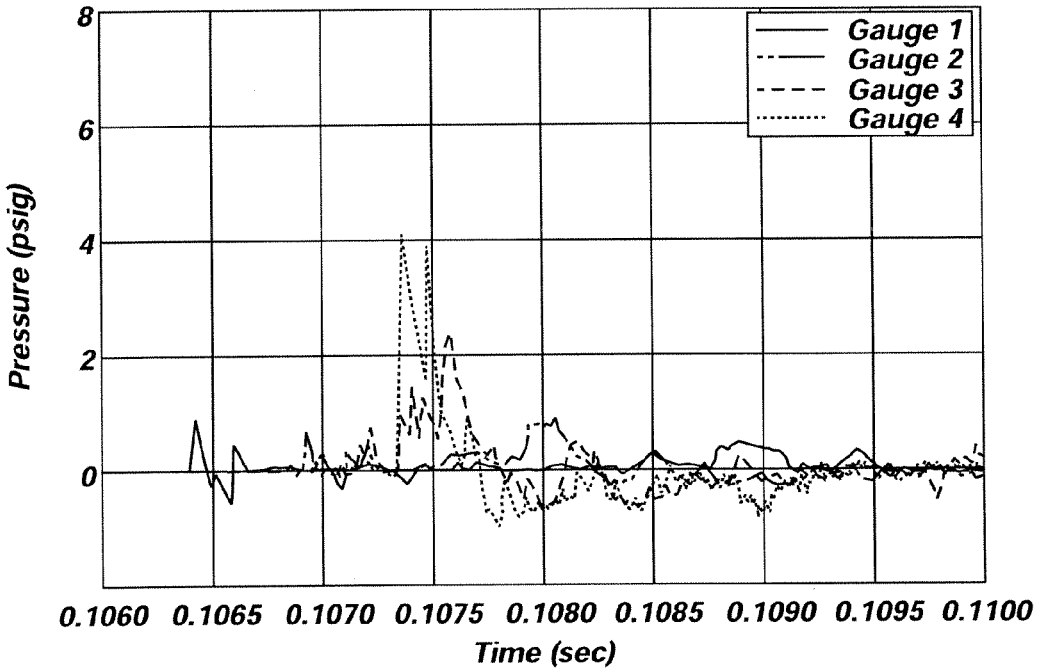
Figure 12:
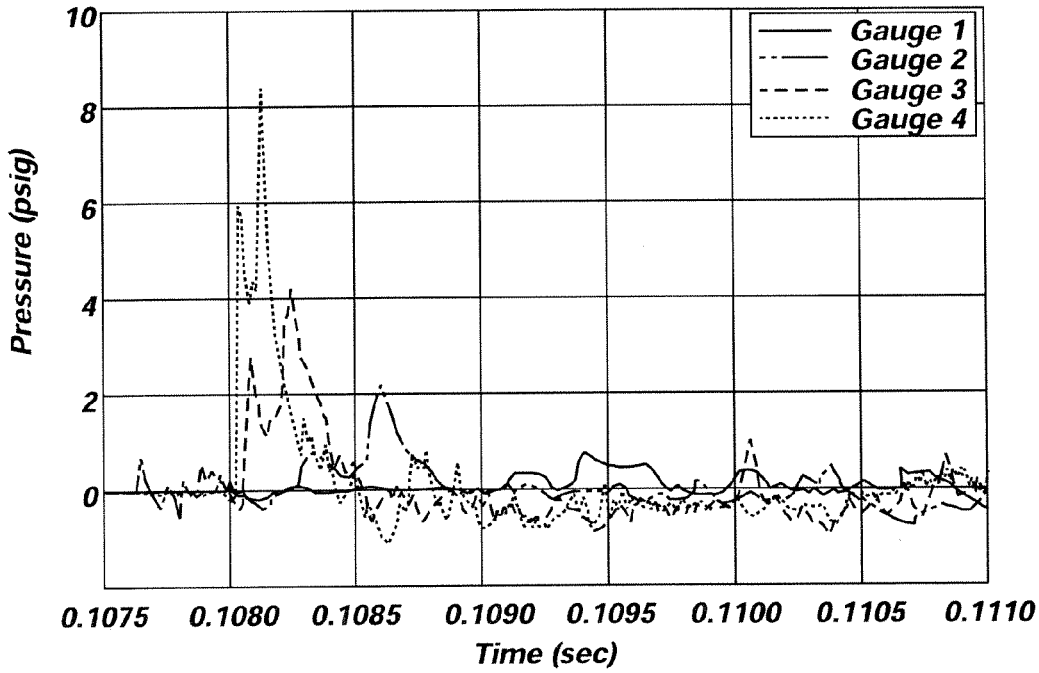
Figure 13:
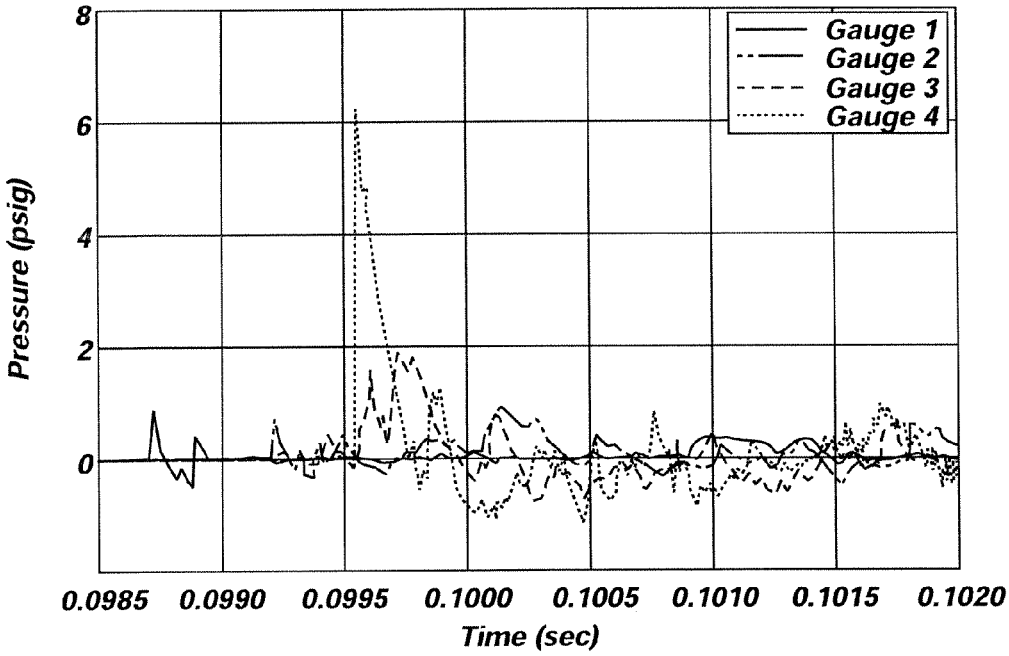
Figure 14:
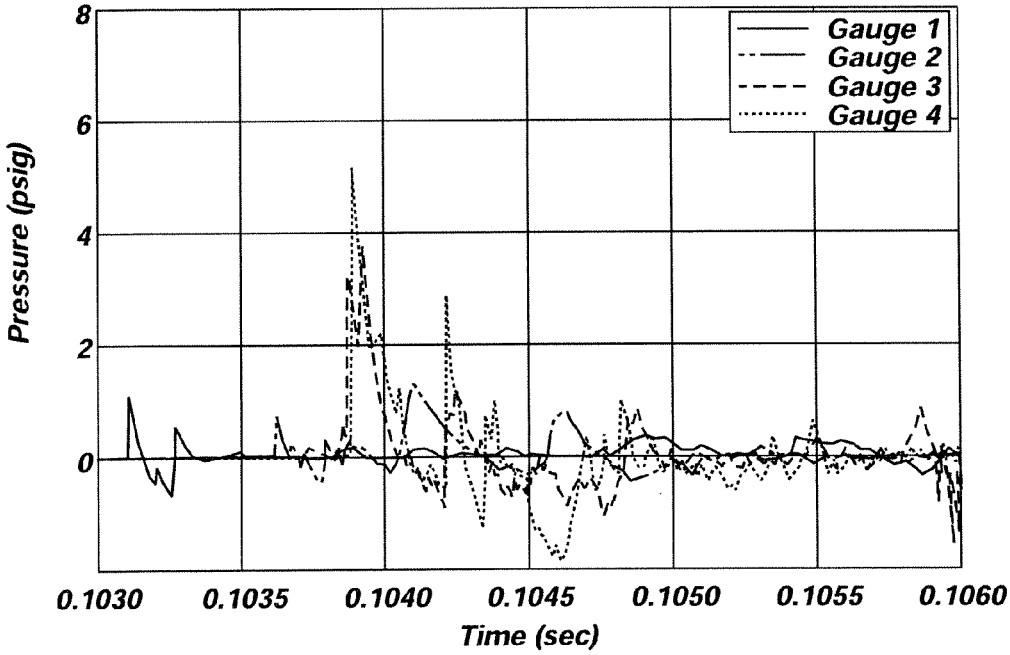
Figure 15:
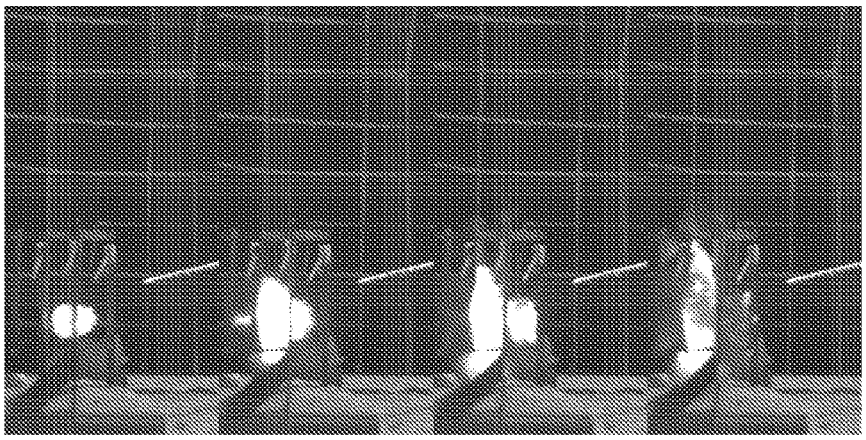
FIGS. 15-33 are still photos taken from high-speed video for reactive material bullets including reactive materials of the present invention.
Figure 16:
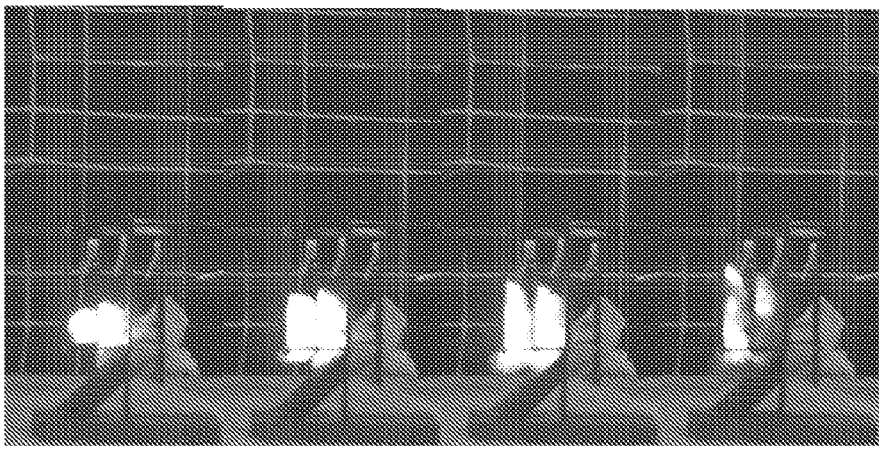
Figure 17:
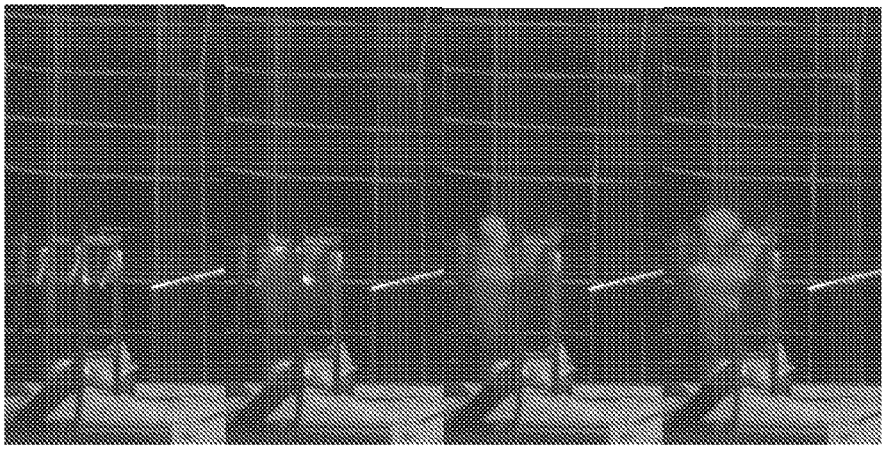
Figure 18:
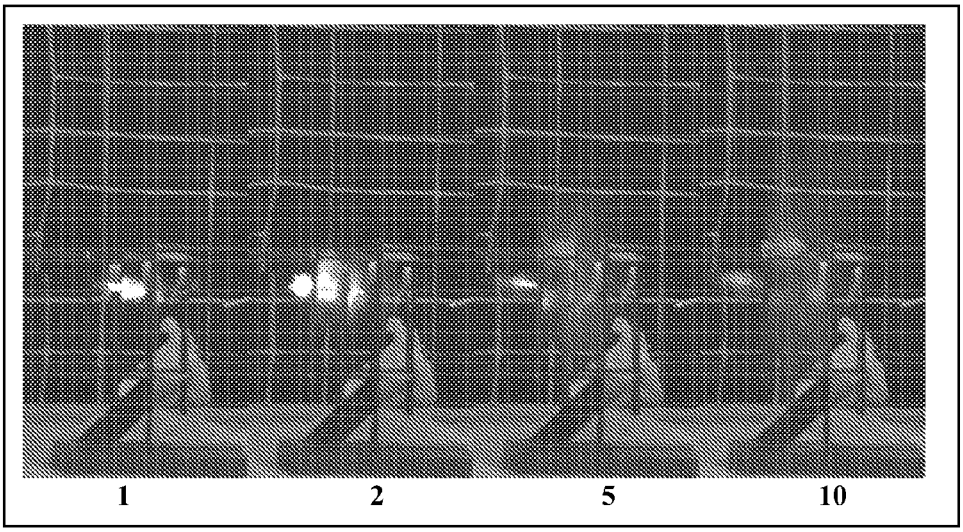
Figure 19:
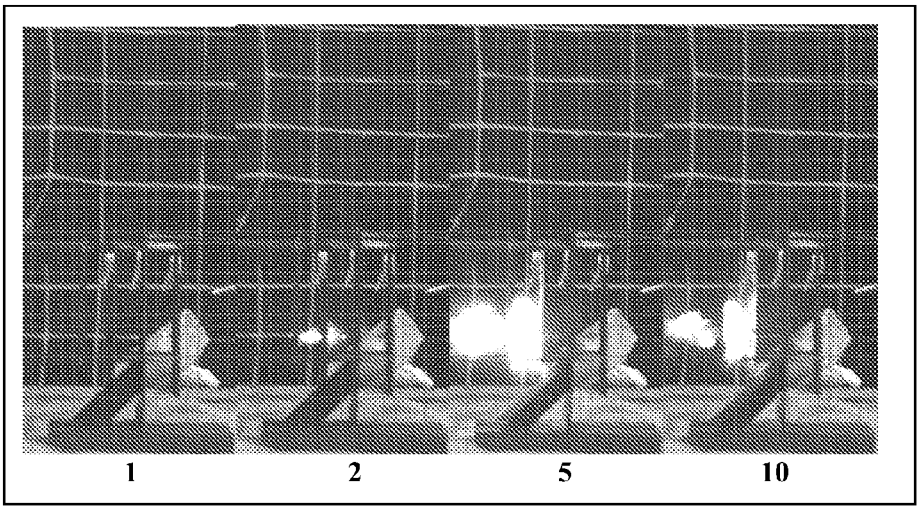
Figure 20:
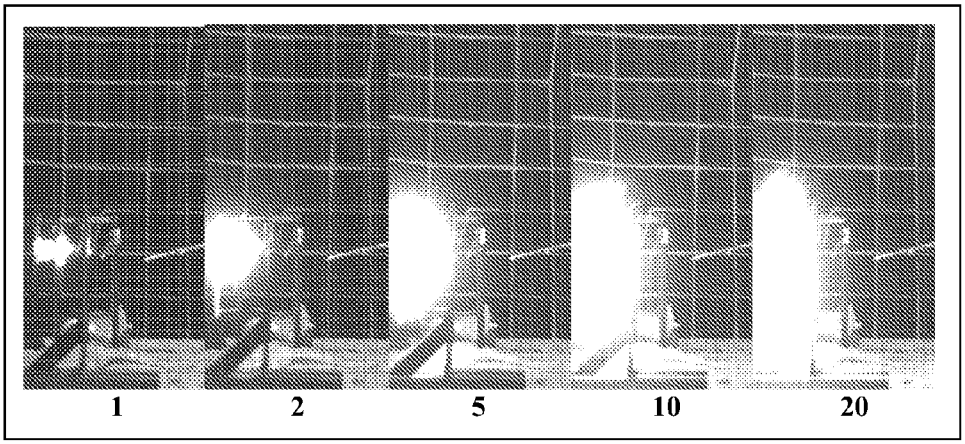
Figure 21:
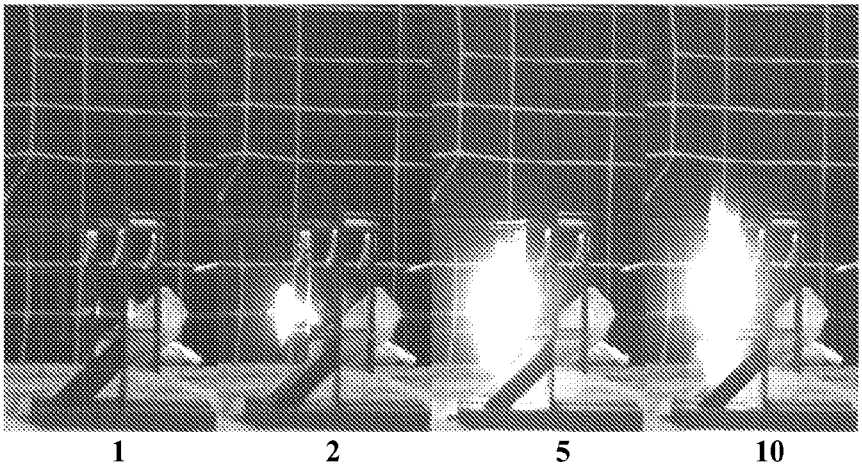
Figure 22:
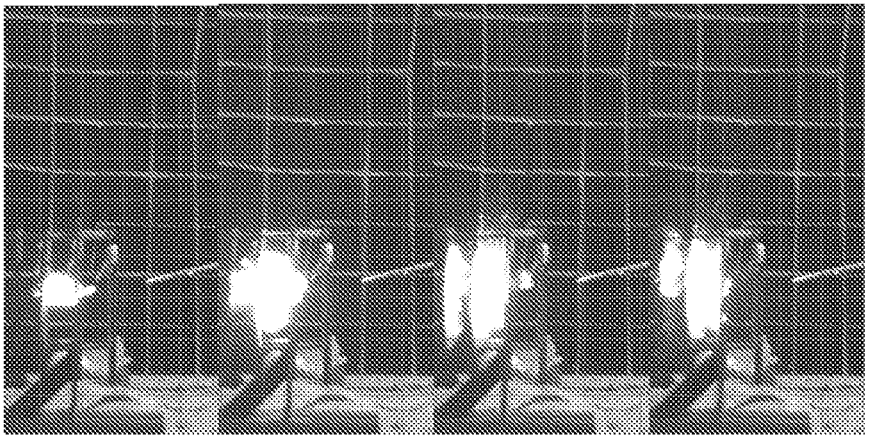
Figure 23:
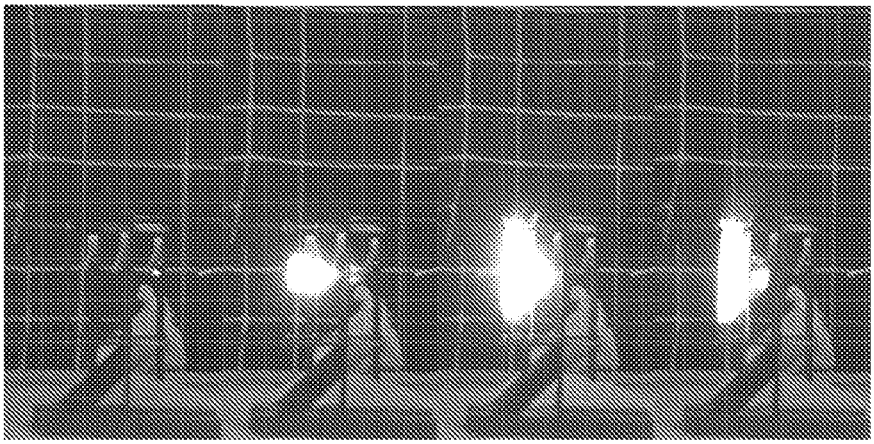
Figure 24:
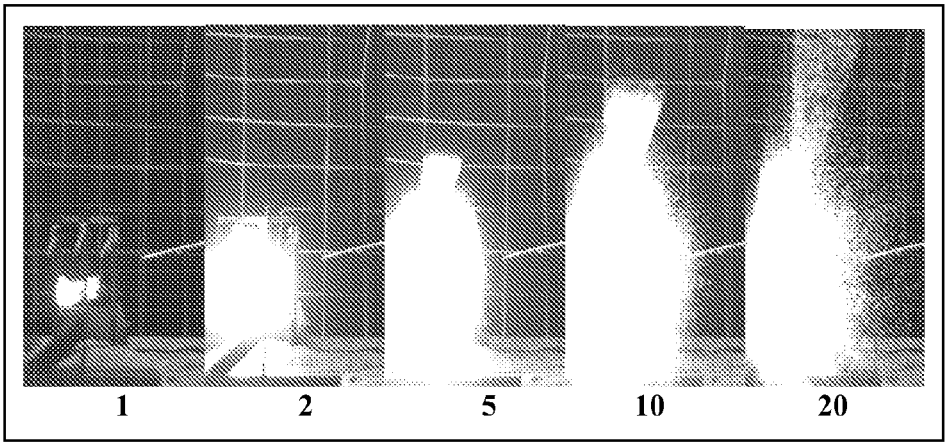
Figure 25:
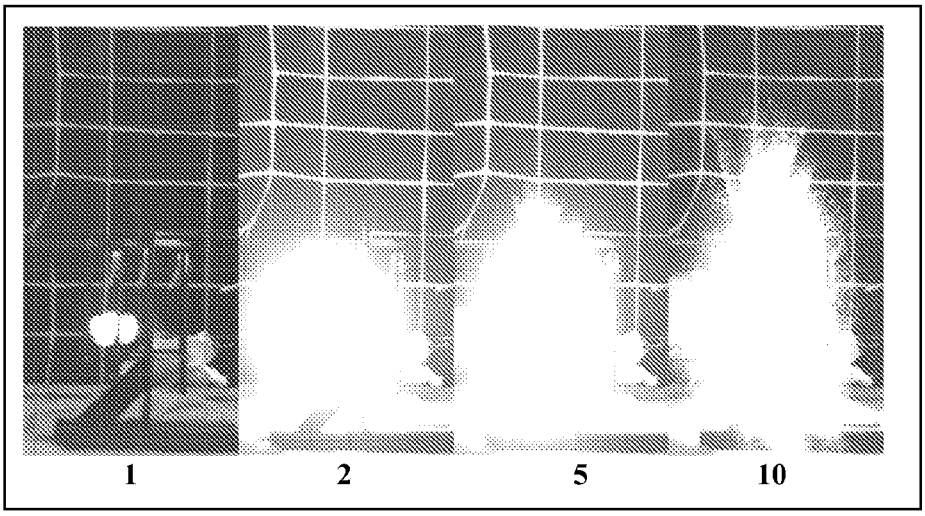
Figure 26:
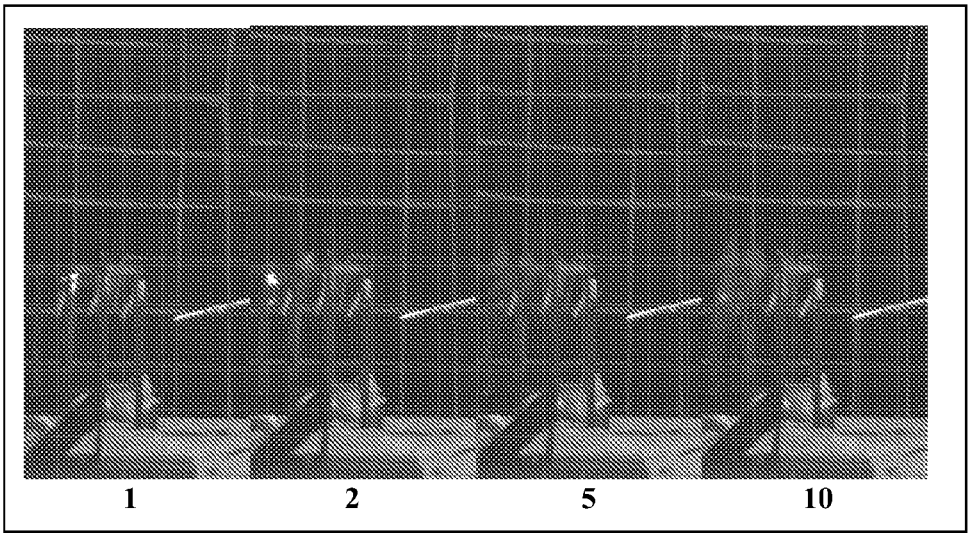
Figure 27:
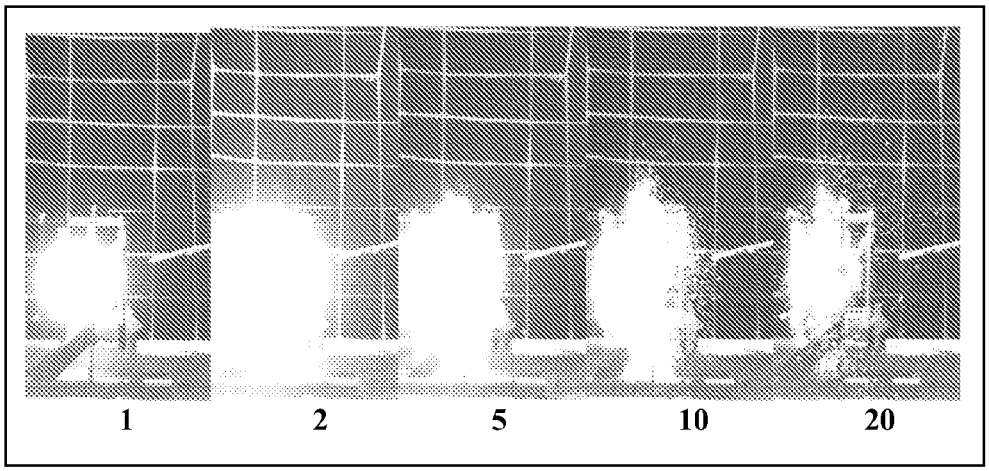
Figure 28:
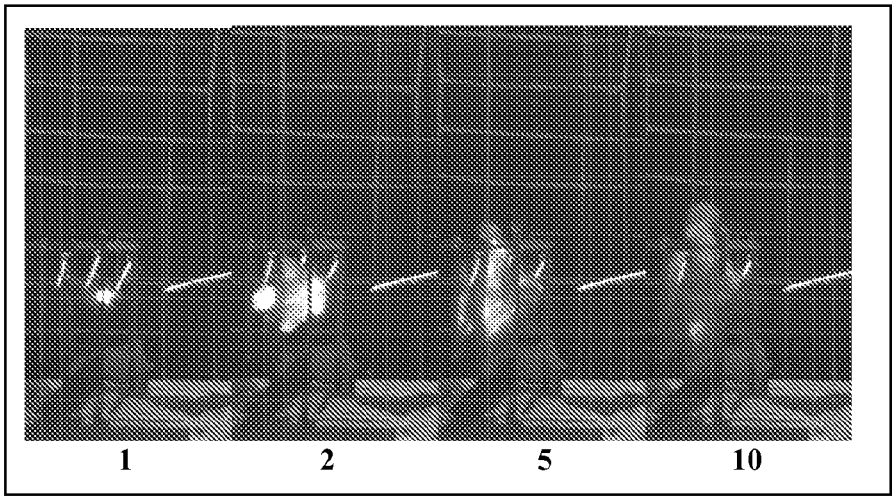
Figure 29:
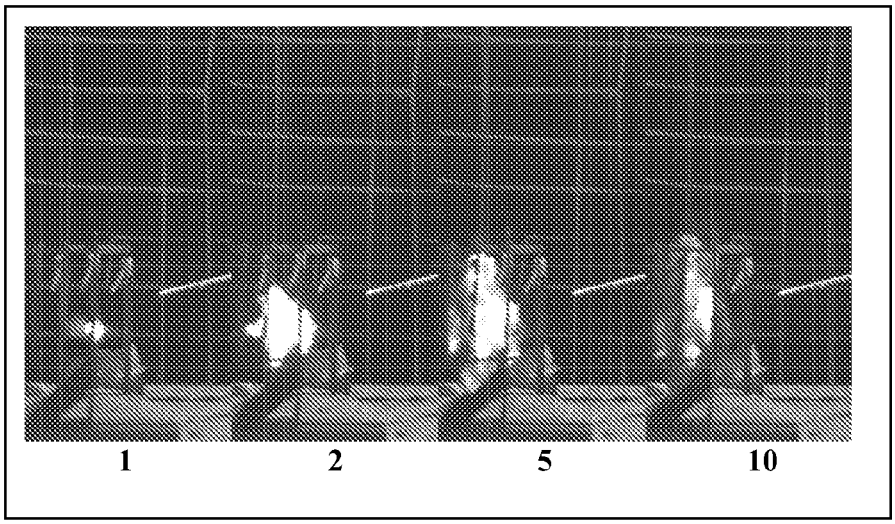
Figure 30:
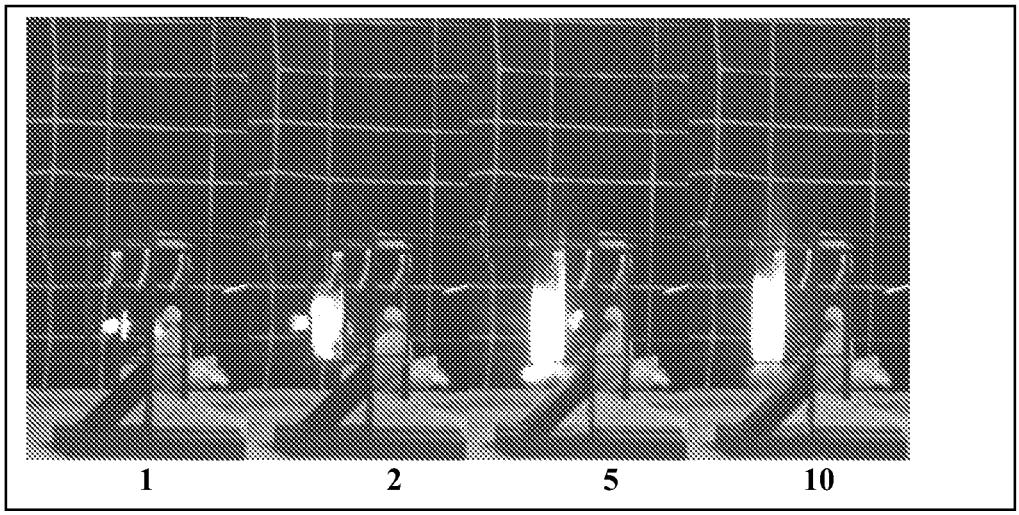
Figure 31:
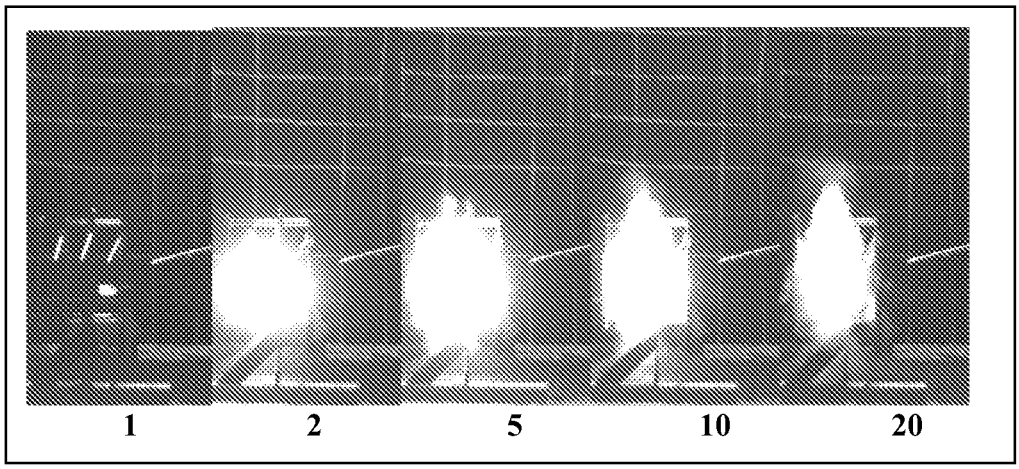
Figure 32:
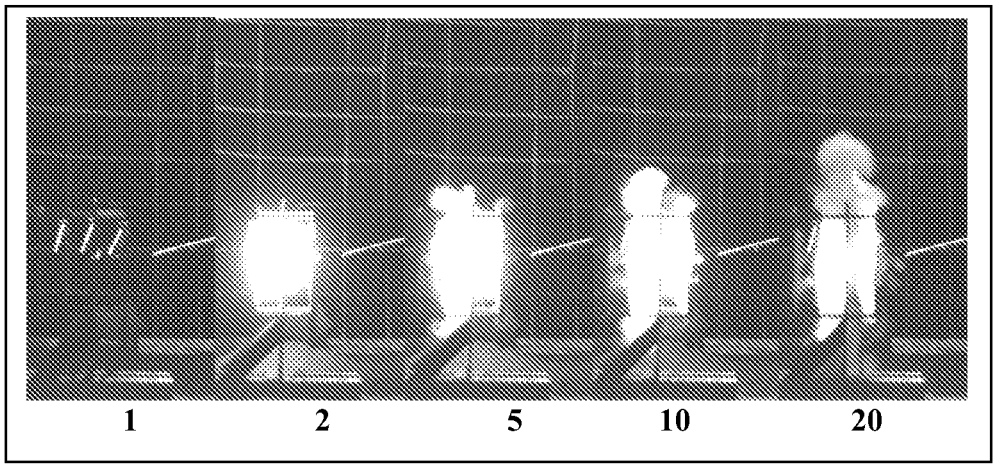
Figure 33:
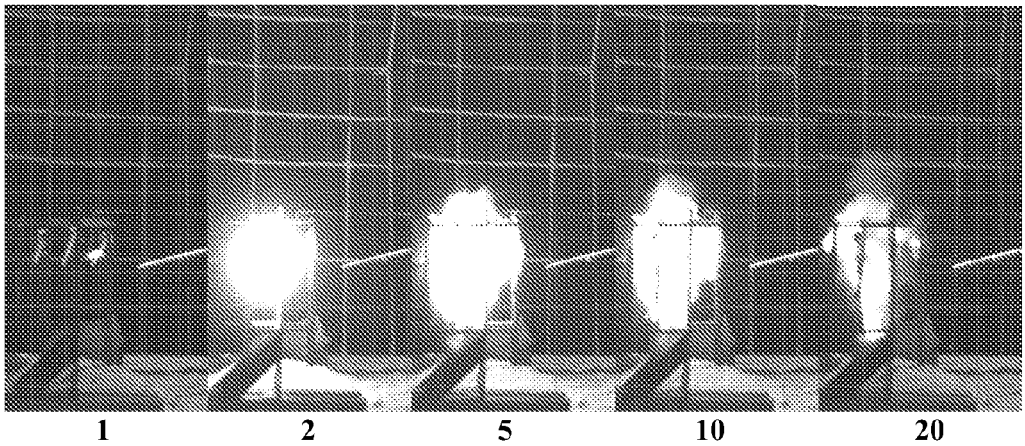
Figure 34:
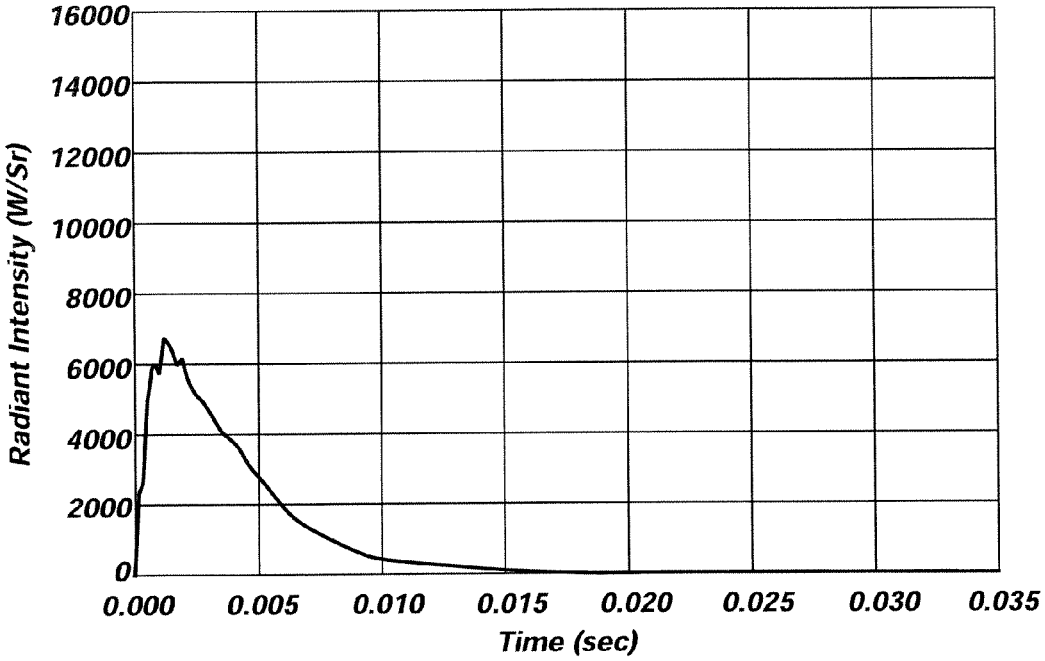
FIGS. 34-53 are infrared intensity-versus-time profiles for reactive material bullets including reactive materials of the present invention.
Figure 35:
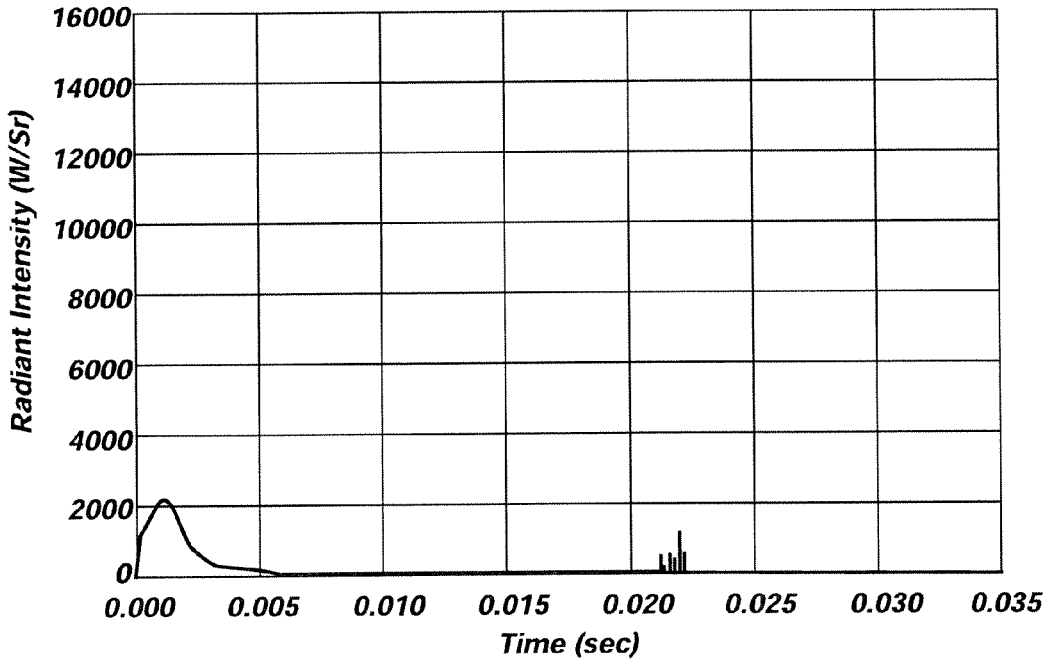
Figure 36:
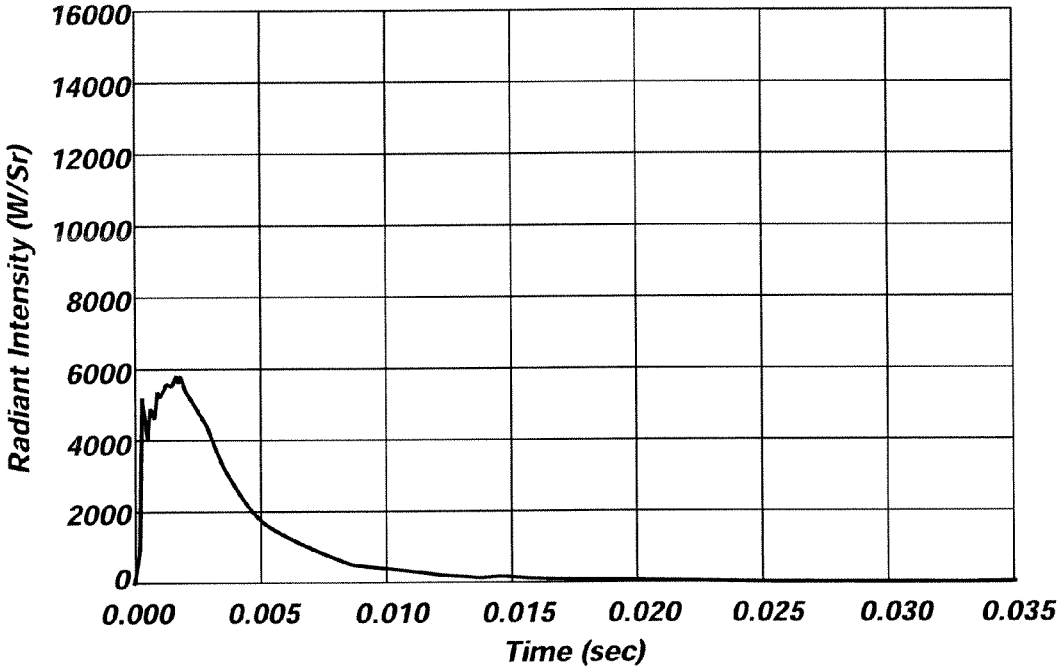
Figure 37:
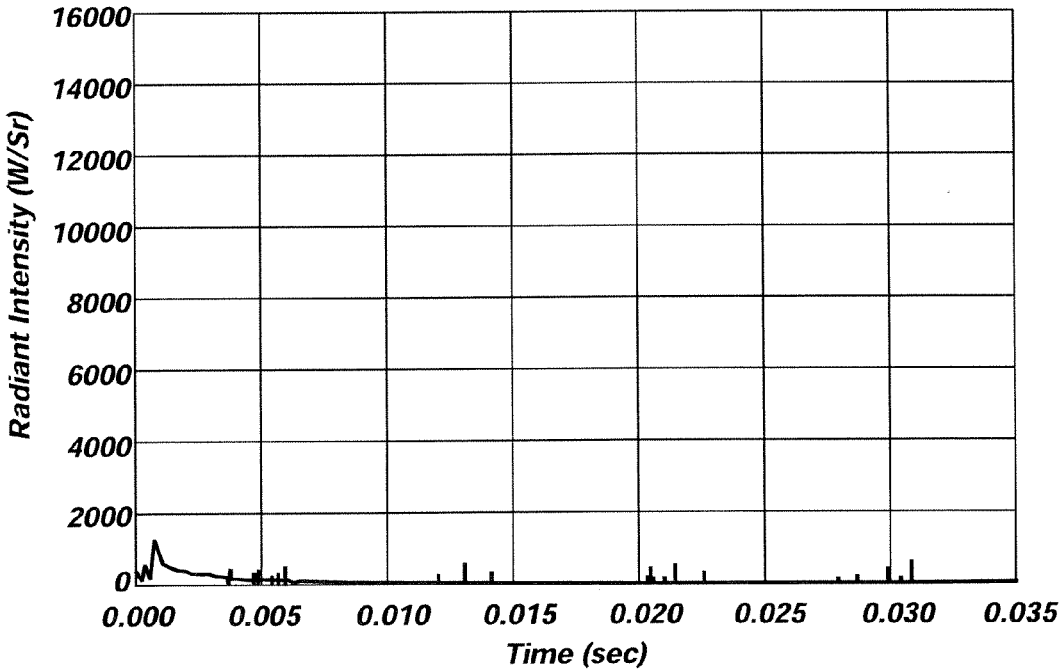
Figure 38:
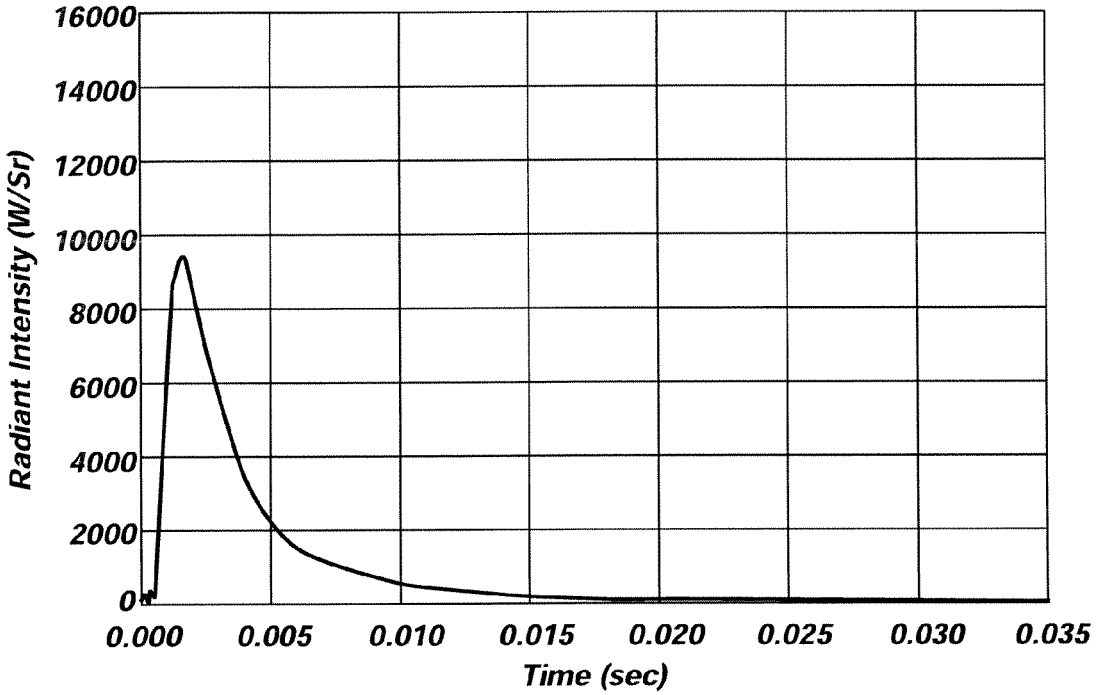
Figure 39:
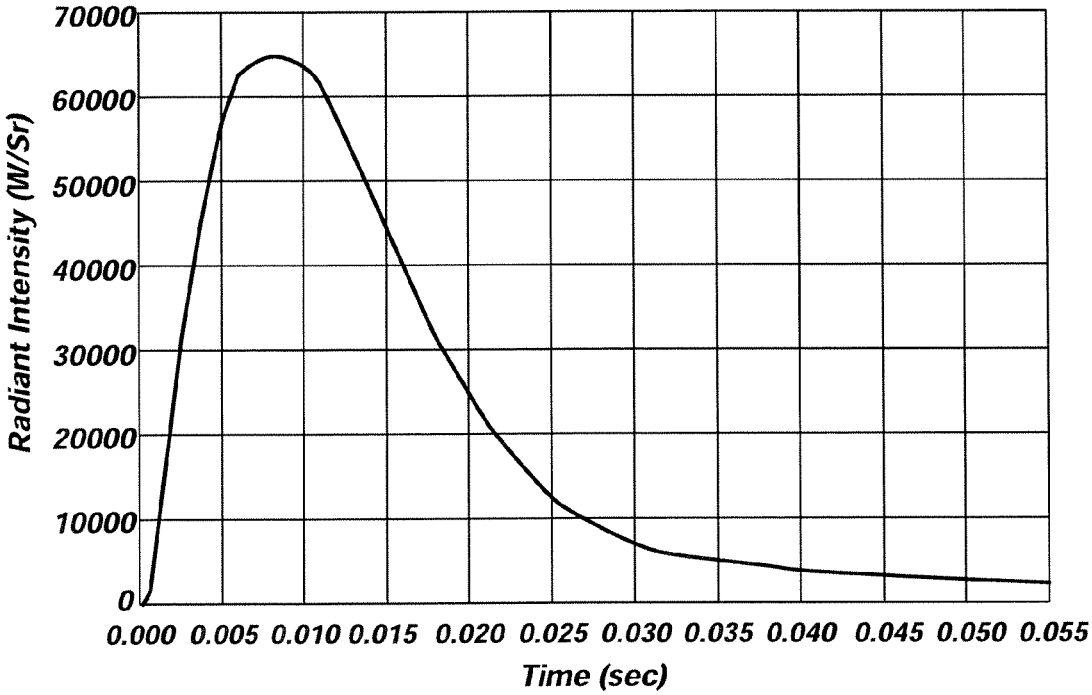
Figure 40:
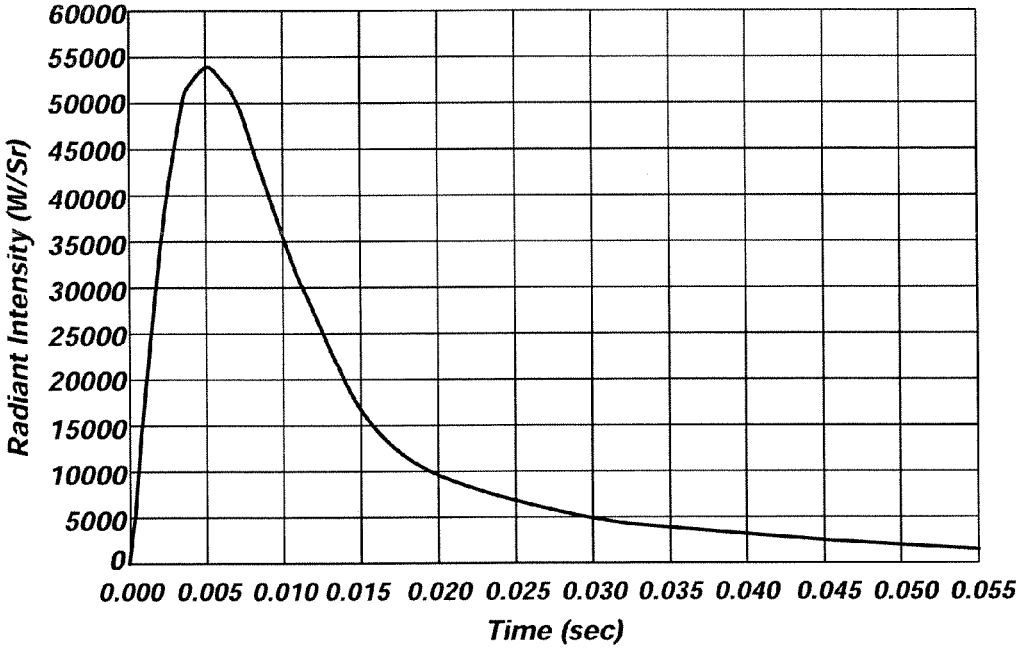
Figure 41:
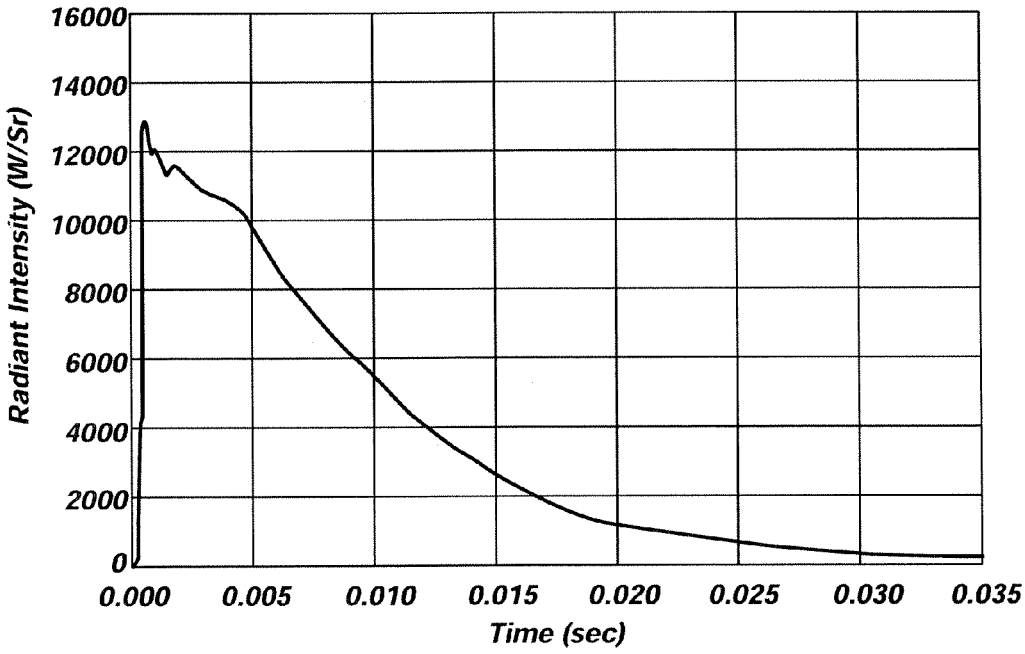
Figure 42:
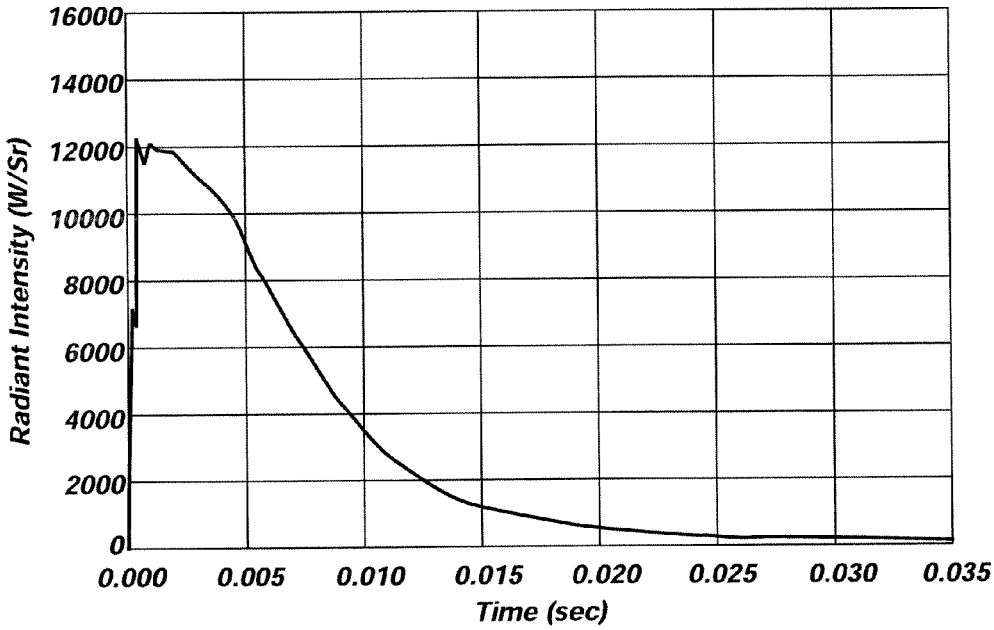
Figure 43:
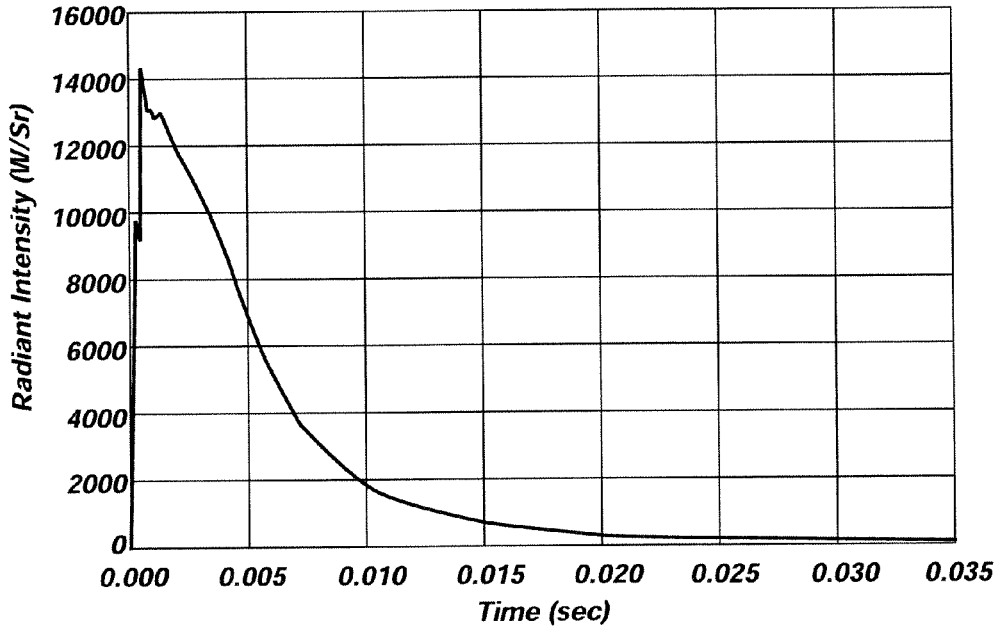
Figure 44:
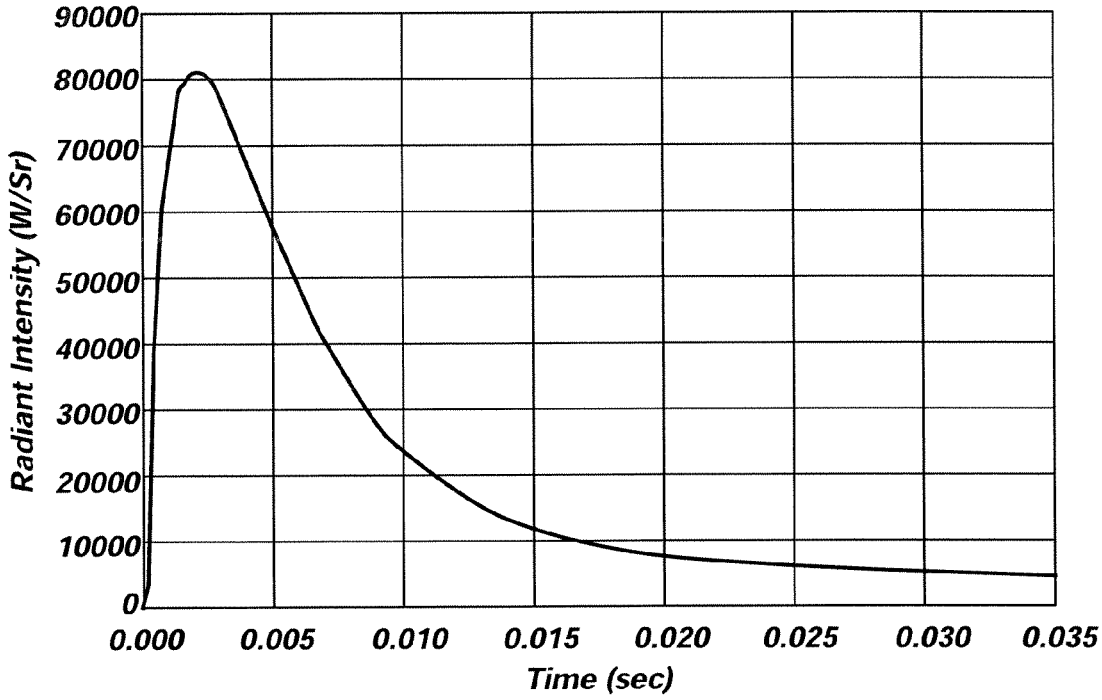
Figure 45:
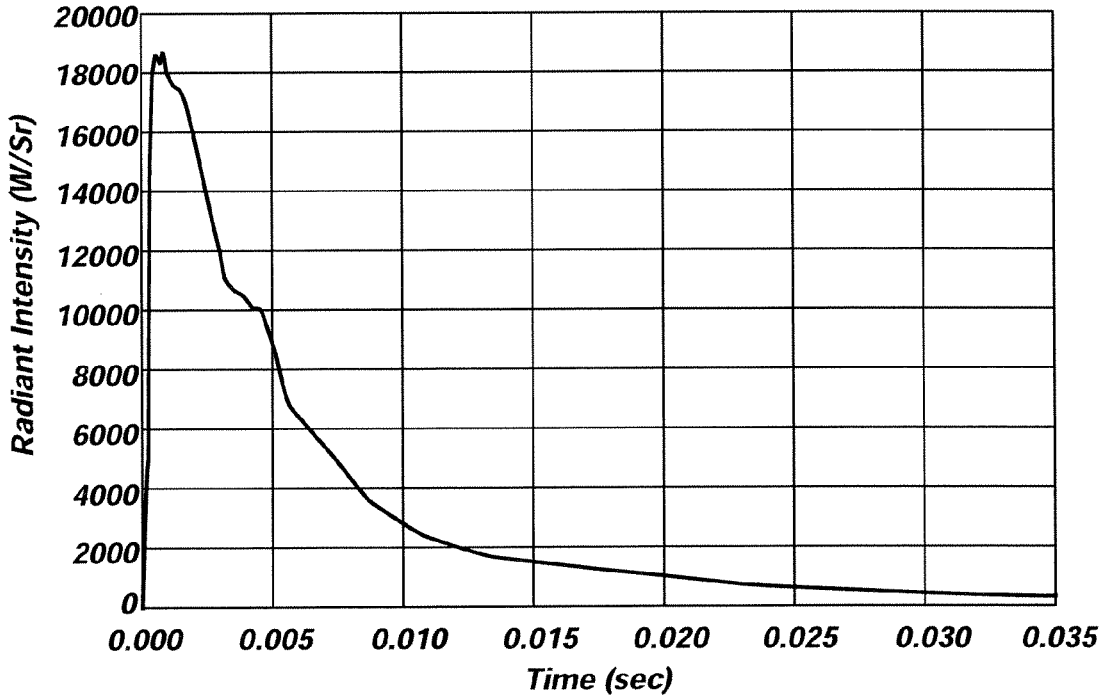
Figure 46:
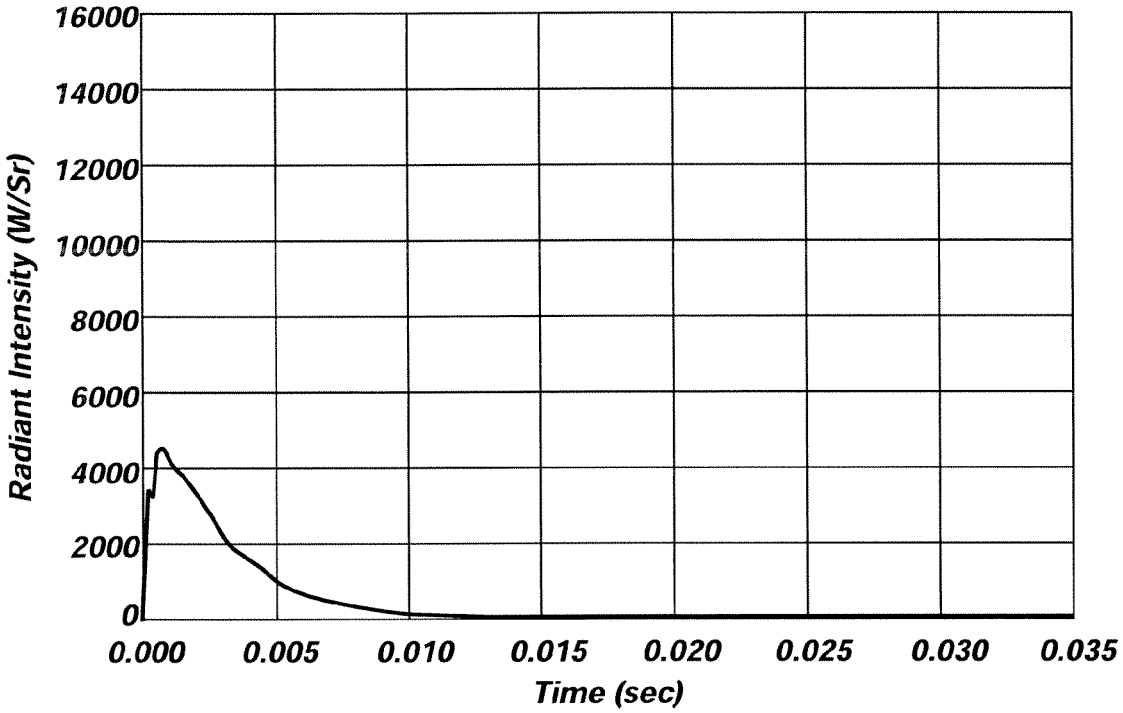
Figure 47:
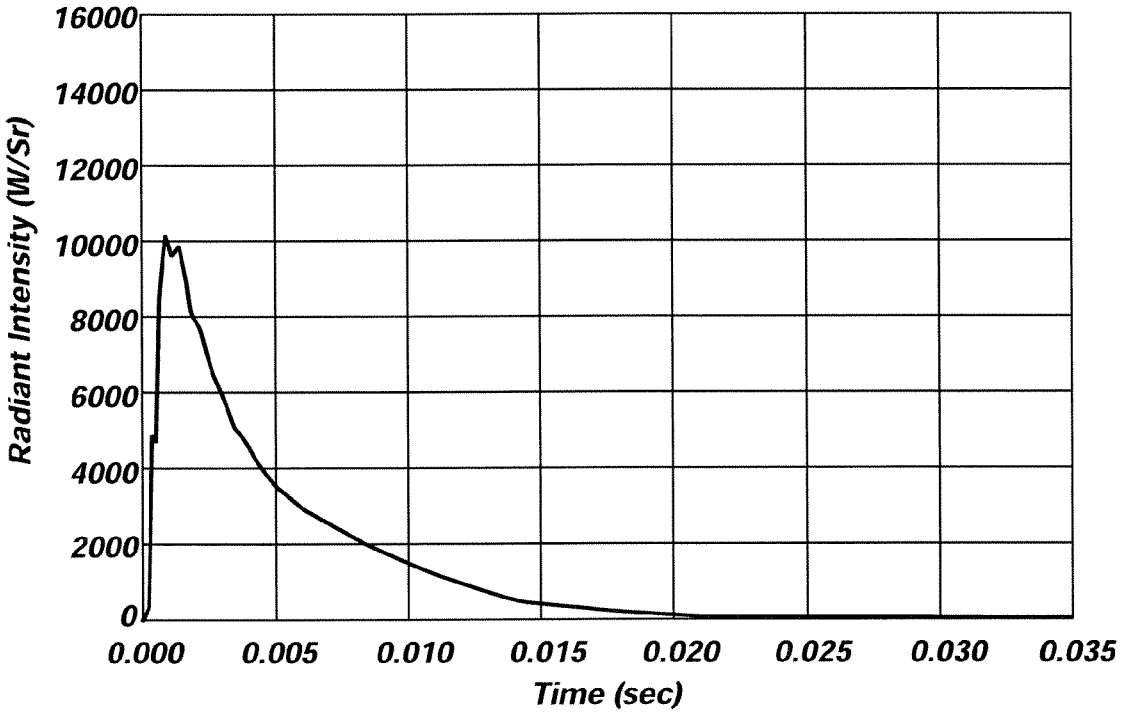
Figure 48:
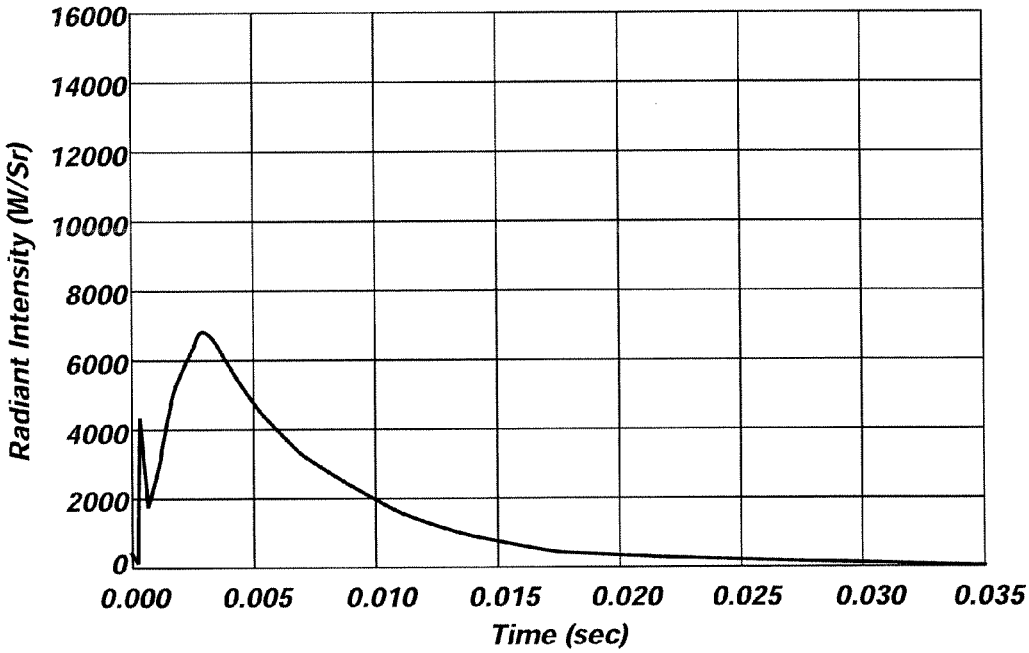
Figure 49:
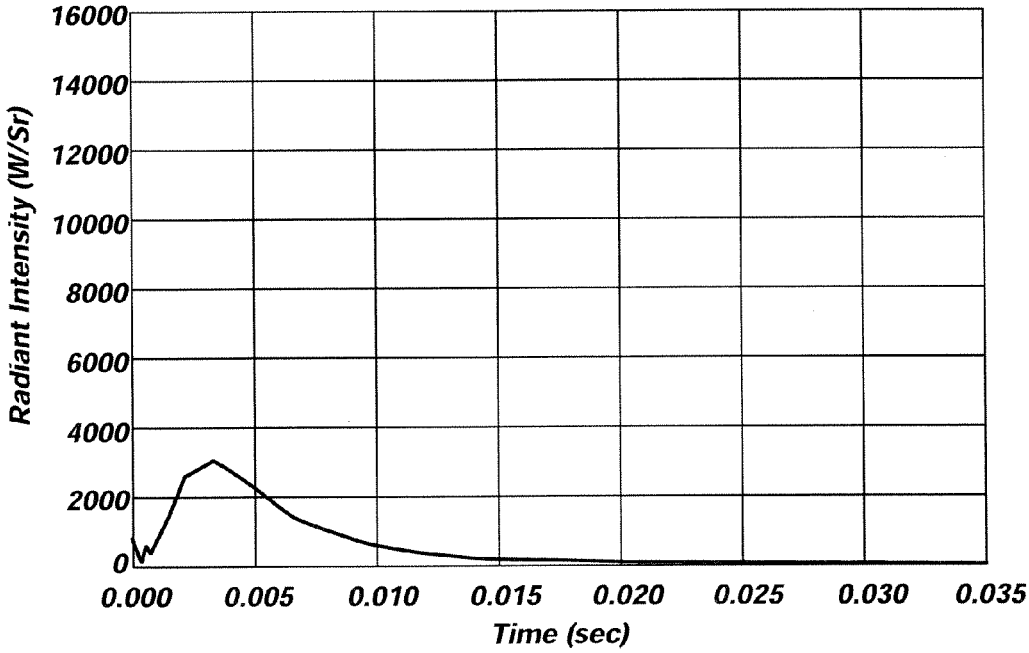
Figure 50:
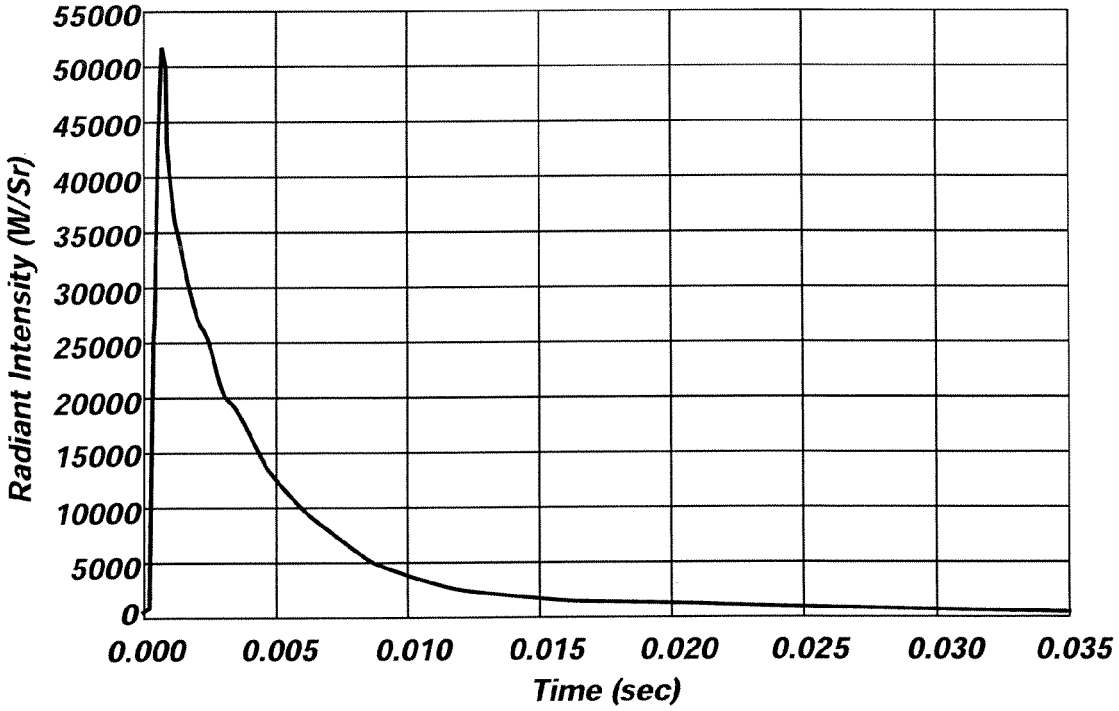
Figure 51:
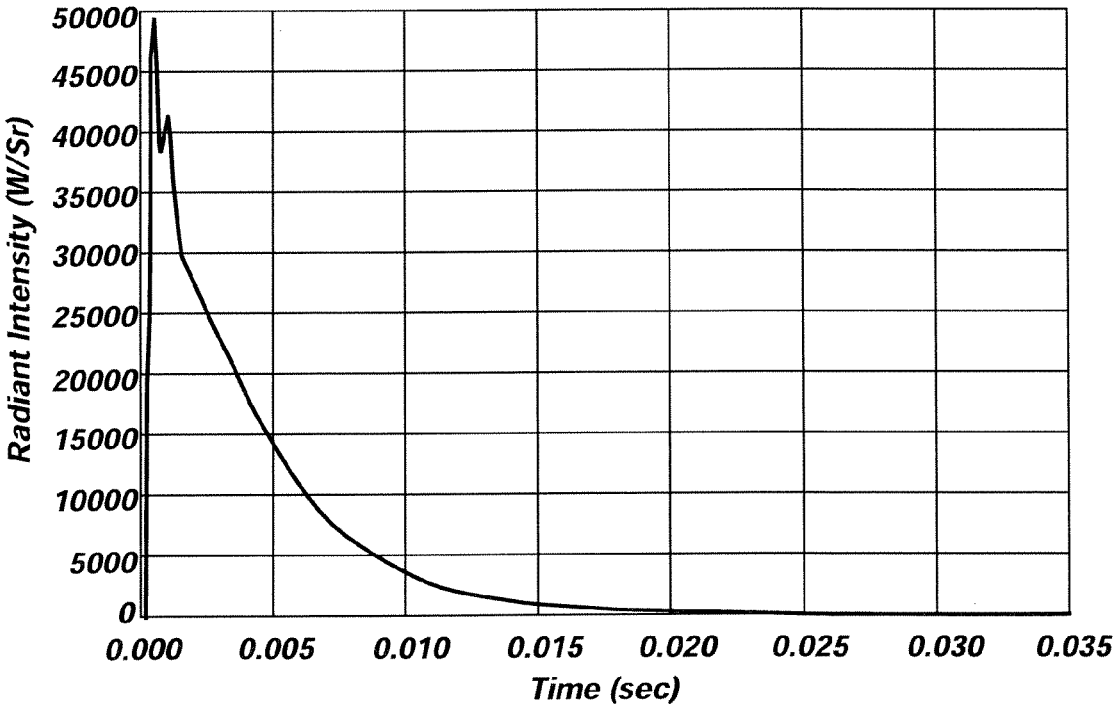
Figure 52:
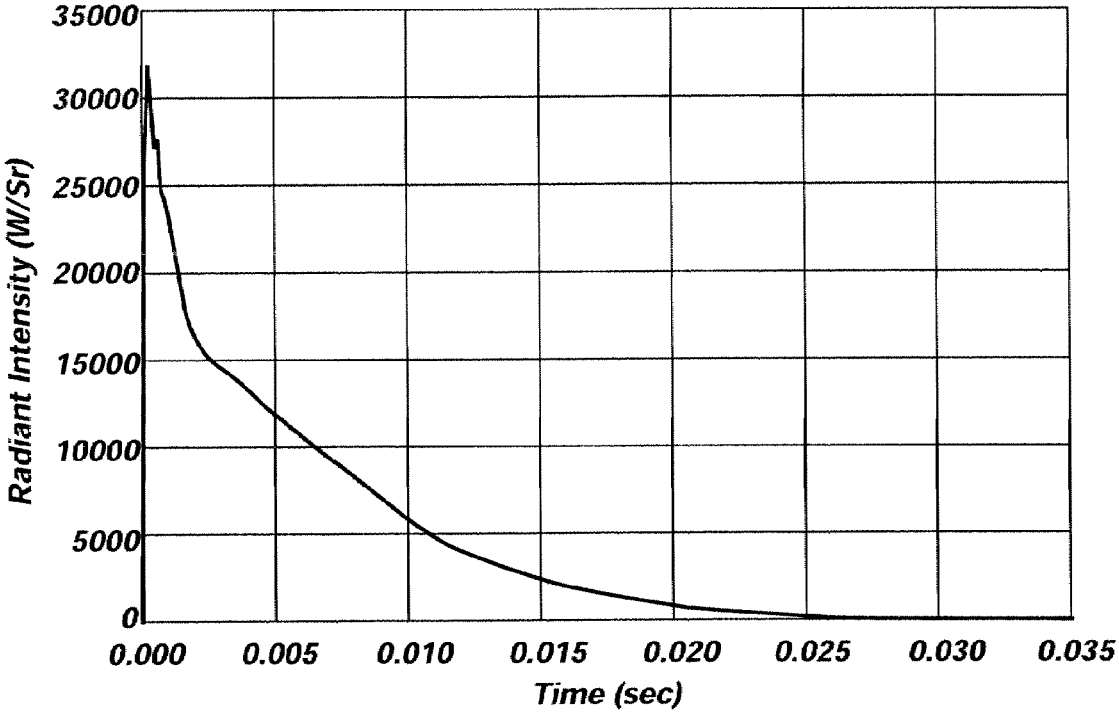
Figure 53:
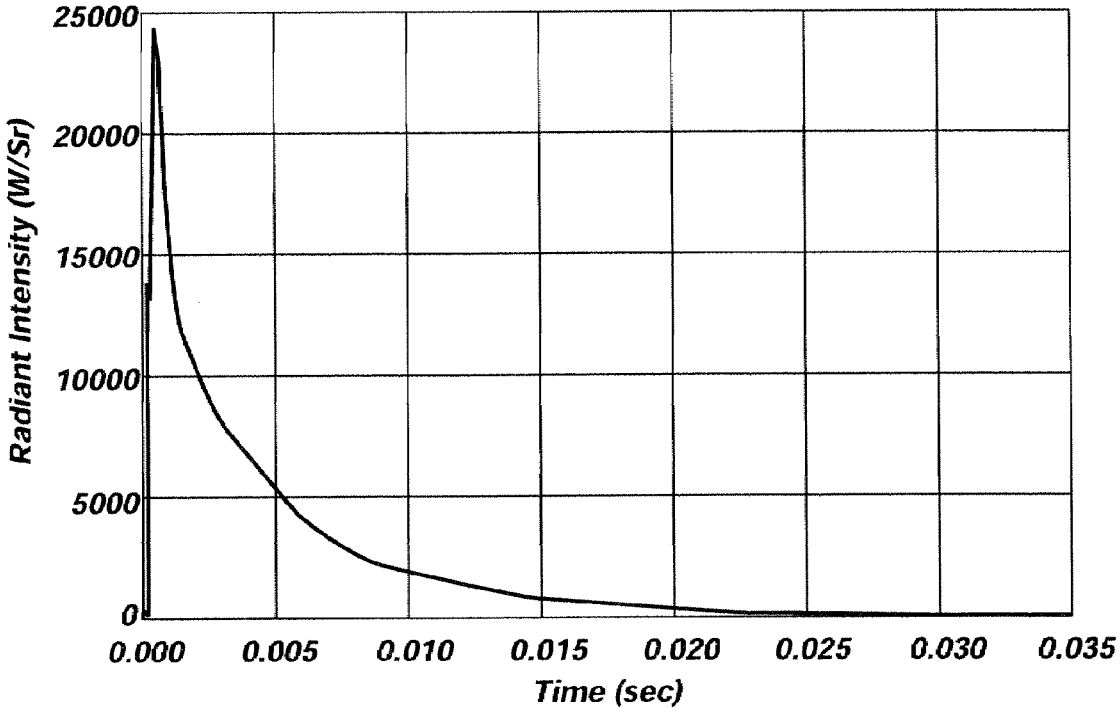

Energy release and initiation threshold of the reactive material formulations were determined by firing the reactive material bullets 2 from a 50-caliber gun 10 into a series of steel plates having a thickness of ⅛-inch at ATK Thiokol's hundred-yard test range, which is schematically shown in FIG. 2. The steel plate array included three, ⅛-inch-thick, carbon steel witness plates 12 in series followed by a ½-inch-thick, carbon steel backer plate 14. The distance between each steel plate was 6 inches. The plates were rigidly held together using steel rods and 6-inch spacers and were mounted on a steel stand.

Data collected for each reactive material bullet test included initiation thresholds, overpressure, IR intensity, and plate damage measurements. High-speed video 16 was used to quantify and document the initial visible reaction (defined as initiation threshold), location of the initial reaction, plume size, relative visible light intensity, and reaction duration. The high-speed video 16 was used to visually ascertain the blast from each reactive material bullet 2. An infrared ("IR") spectrometer 18 and IR light screens 20 were used to record the magnitude of light, or flame intensity, emitted by each reactive material bullet 2. Plate damage was measured to determine the mechanical energy of each reactive material formulation. Pressure output was measured between each steel plate using overpressure gauges 22 and amplifiers 24. This data was acquired using a data acquisition system 26.

Data for the best performing formulations is shown in Tables 7 and 8. In addition, the weight of each reactive material bullet 2 is shown in these tables.

TABLE 7

Plate Damage, Plume Size, IR Intensity, and Overpressure of the Formulations Tested in the Bullets for Thin-Skinned Targets.

| Mix No. | Bullet No. | Reactive Material Formulation | Avg. Ullage (in.) | Avg. Comp. Wt. (g) | Area of Max Plate Damage ($in^2$) | Plume Size Height (ft) | Plume Size Width (ft) | Plume Size Area ($ft^2$) | Avg. IR Integral | Transducer Data Transducer # | Transducer Data Peak Output (psi) |
|---|---|---|---|---|---|---|---|---|---|---|---|
| 1791-100-2 | 601 | W/KP/VITON ® | 0.2280 | 8.837 | 2.9 | 2 | 1 | 2 | 31 | 4 | 8 |
| 1943-32-13 | 607 | IND174/KP/Binder | 0.2293 | 4.419 | 1.7 | 0.5 | 0.5 | 0.25 | 0 | 3 | 5.5 |
| 1943-32-03 | 622 | Al/Zr/VITON ® | 0.2325 | 5.169 | 2.9 | 3.5 | 1 | 3.5 | 1121 | 4 | 2.5 |
| 1943-32-07 | 629 | Mg/CuO/VITON ® | 0.2270 | 3.008 | 0.6 | 1.5 | 1 | 1.5 | 126.7 | 3 & 4 | 9 |
| 1943-32-12 | 634 | Hf/THV220 | 0.2335 | 12.989 | 3.8 | 6 | 4 | 24 | 795 | 4 | 9.5 |
| 1943-32-01 | 640 | Al/Boron/VITON ® | 0.2290 | 2.864 | 1.7 | 0.2 | 0.2 | 0.04 | 0 | 1-4 | 1 |
| 2002-1-1 | 655 | Zr/PTFE | 0.227 | 6.350 | 1.3 | 3 | 2.5 | 7.5 | 117 | 3 | 4.5 |
| 1943-34D | 659 | IND174 & 40% KP | 0.233 | 6.826 | 1.3 | 1.5 | 1 | 1.5 | 17.1 | 3 | 6.5 |
| 1943-34E | 661 | IND174 & 20% KP | 0.231 | 9.522 | 1.6 | 2 | 1 | 2 | 51.3 | 4 | 10 |
| PAX-2A | 665 | HMX/Binder | 0.228 | 3.148 | 3.8 | 1 | 1 | 1 | 0 | 3 & 4 | 11.5 |
| 1943-37A | 672 | Al/KP/Si/THV | 0.23025 | 4.206 | 2.2 | 2.5 | 1.5 | 3.75 | 195.2 | 3 & 4 | 11.5 |
| 1943-37B | 674 | IND174/Al/Si/S/KP/BG/A/F | 0.2325 | 5.090 | 2.0 | 3 | 1.5 | 4.5 | 159.3 | 3 & 4 | 11.5 |
| PAX-2A & 1943-37A | 676 | HMX/Binder & Al/KP/Si/THV | 0.227 | 1.743/3.868 | 1.8 | 2.5 | 1.5 | 3.75 | 77.5 | 2, 3, & 4 | 11.5 |

Mix no. 1943-32-12 (Hf/THV220) is analogous to Mix no. 1943-26E

TABLE 8

Plate Damage, Plume Size, IR Intensity, and Overpressure of the Formulations Tested in the Bullets for Thicker-Skinned Targets.

| Mix No. | Bullet No. | Reactive Material Formulation | Avg. Ullage (in.) | Avg. Comp. Wt. (g) | Area of Max Plate Damage ($in^2$) | Plume Size Height (ft) | Plume Size Width (ft) | Plume Size Area ($ft^2$) | Avg. IR Integral | Transducer Data Transducer # | Transducer Data Peak Output (psi) |
|---|---|---|---|---|---|---|---|---|---|---|---|
| 1791-100-2 | 605 | W/KP/VITON ® | 0.583 | 5.9115 | 1.8 | 0.5 | 1 | 0.5 | 25.9 | 3 | 6 |
| 1943-32-13 | 610 | IND/KP/Binder | 0.570 | 2.9095 | 0.7 | 0.4 | 1 | 0.4 | 5.1 | 4 | 7 |
| 1943-32-11 | 616 | Zr/THV - 65/35 | 0.579 | 3.951 | 0.25 | 1 | 1 | 1 | 34.8 | 4 | 2.5 |
| 1943-32-03 | 625 | Al/Zr/VITON ® | 0.570 | 3.4855 | 0.45 | 3 | 0.5 | 1.5 | ET | 4 | 2 |
| 1943-32-07 | 632 | Mg/CuO/VITON ® | 0.582 | 2.021 | 0.45 | 1.5 | 1 | 1.5 | 102 | 4 | 5 |
| 1943-32-12 | 637 | Hf/THV220 | 0.570 | 8.7535 | 2.4 | 5 | 4 | 20 | ET | 4 | 8.5 |
| PAX-2A | | HMX/Binder | 0.576 | 1.967 | 0.49 | 1.5 | 0.5 | 0.75 | 52 | 4 | 6 |

Pressure-versus-time profiles for the reactive material bullets that included the formulation Nos. 1791-100-2, 1791-100-2, 1943-32-13, 1943-32-12, 1943-32-11, 1943-32-03, 1943-32-03, 1943-32-07, 1943-32-07, 1943-32-12, PAX-2A, and PAX-2A are shown in FIGS. 3-14, respectively. Still photos taken from high-speed video for the reactive material bullets that included the formulation Nos. 1791-100-2 (bullet for thin-skinned targets), 1791-100-2 (bullet for thicker-skinned targets), 1943-32-13 (bullet for thin-skinned targets), 1943-32-13 (bullet for thicker-skinned targets), 1943-32-11 (bullet for thicker-skinned targets), 1943-32-03 (bullet for thin-skinned targets), 1943-32-03 (bullet for thicker-skinned targets), 1943-32-07 (bullet for thin-skinned targets), 1943-32-07 (bullet for thicker-skinned targets), 1943-32-12 (bullet for thin-skinned targets), 1943-32-12 (bullet for thicker-skinned targets), 1943-32-01 (bullet for thin-skinned targets), 2002-1-1 (bullet for thin-skinned targets), 1943-34D (bullet for thin-skinned targets), 1943-34E (bullet for thin-skinned targets), PAX-2A (bullet for thin-skinned targets), 1943-37A (bullet for thin-skinned targets), 1943-37B (bullet for thin-skinned targets), and PAX-2A & 1943-37A (bullet for thin-skinned targets) are shown in FIGS. 15-33, respectively.

The IR intensity-versus-time profiles for the reactive material bullets that included the formulation Nos. 1791-100-2, 1791-100-2, 1791-100-2, 1943-32-13, 1943-32-11, 1943-32-03, 1943-32-03, 1943-32-07, 1943-32-07, 1943-32-07, 1943-32-12, 2002-1-1, 1943-34D, 1943-34E, PAX-2A, PAX-2A, 1943-37A, 1943-37A, 1943-37B, and PAX-2A & 1943-37A are shown in FIGS. 34-53, respectively.

The reactive materials of the present invention exhibited a high-energy output when tested in the reactive material bullets. These reactive materials provided blast and incendiary effects in the reactive material bullets. The reactive materials that included the class 1.1 explosives exhibited enhanced performance. However, the reactive materials that did not include the class 1.1 explosives, such as the intermetallic-type compositions, the thermite-type compositions, and the INDALLOY®-containing compositions also exhibited good performance.

Figure 54:
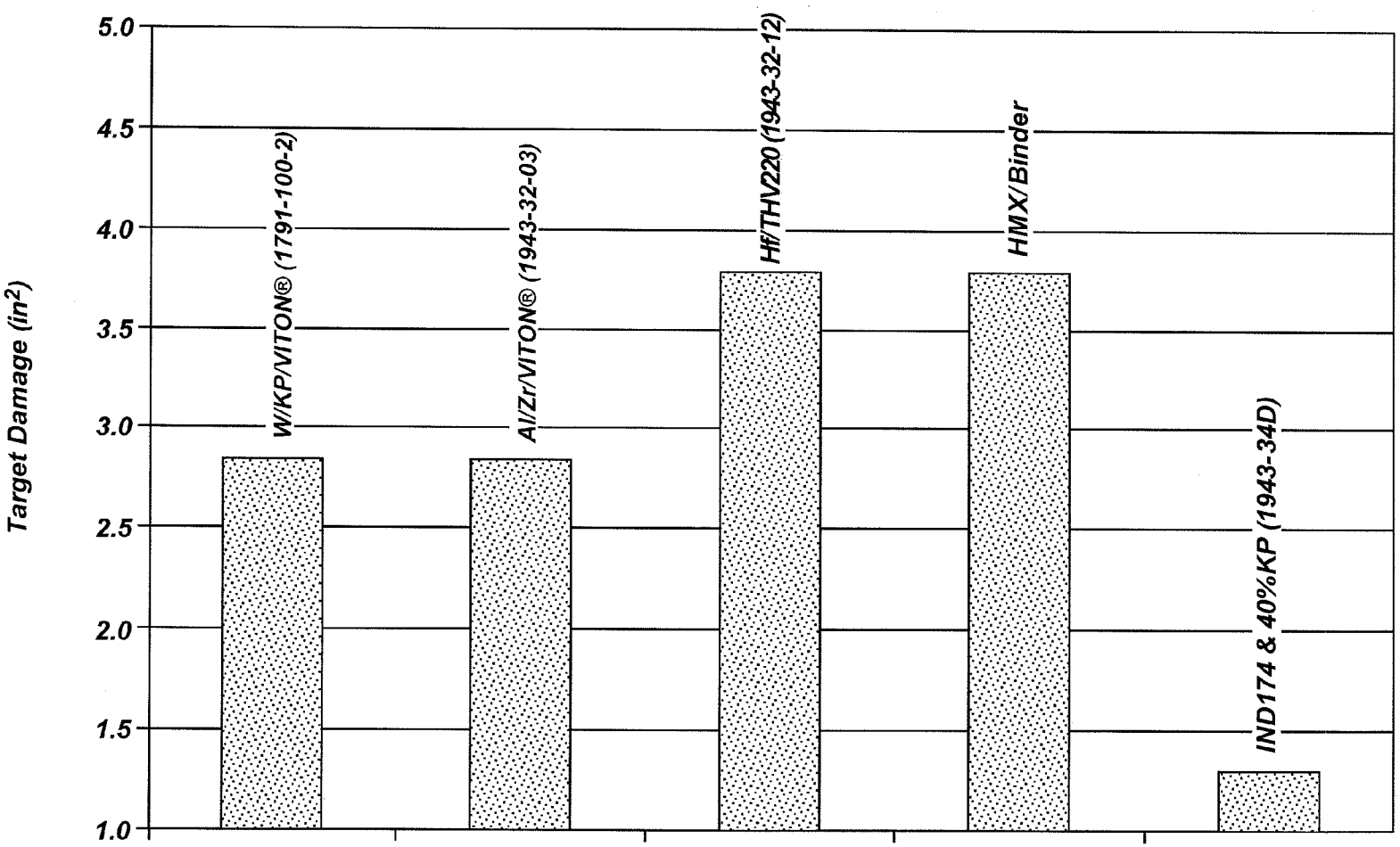
FIGS. 54-56 are bar graphs that summarize reactive material formulations that provide good target damage, plume size, and pressure output, respectively.
Figure 55:
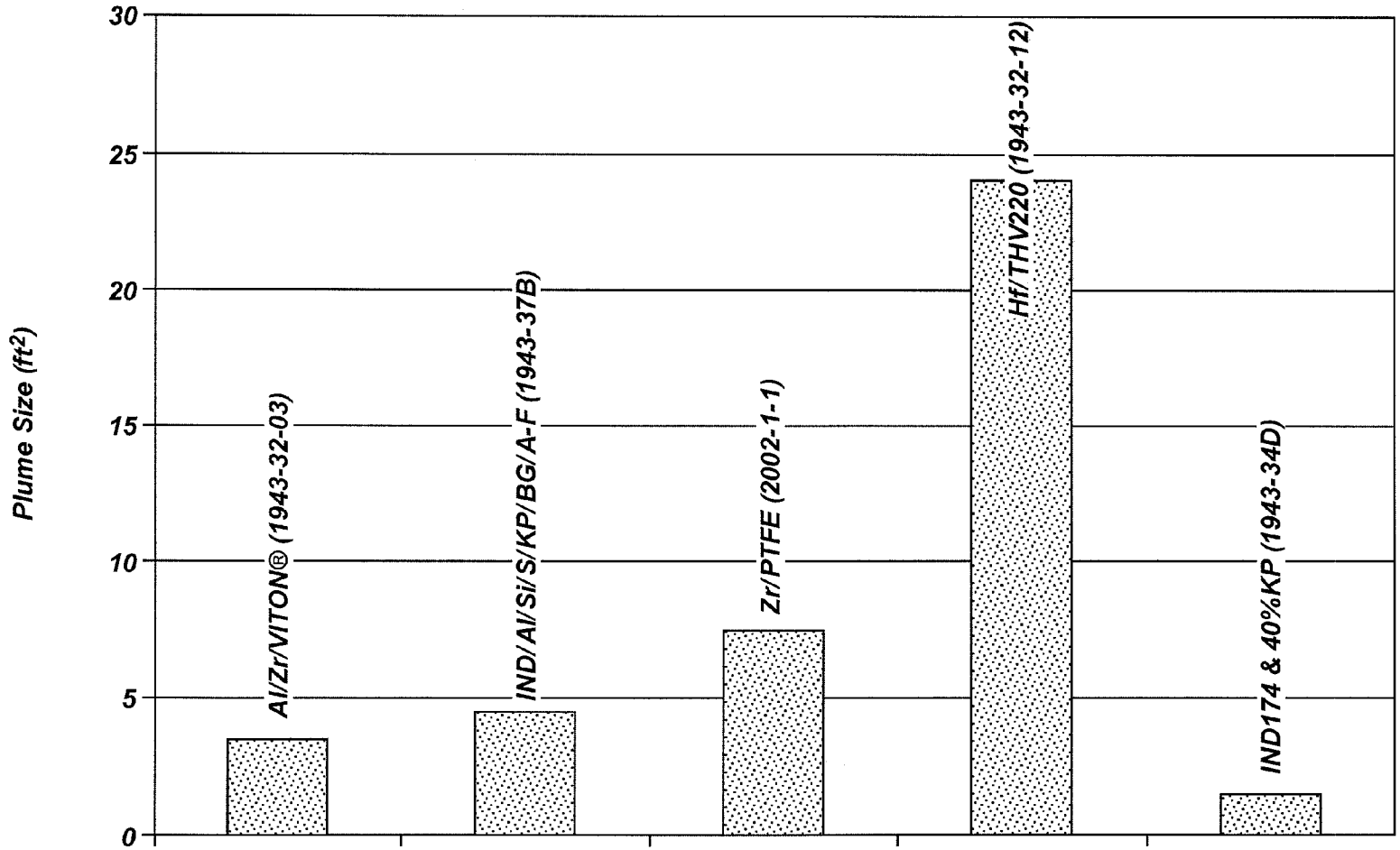
Figure 56:
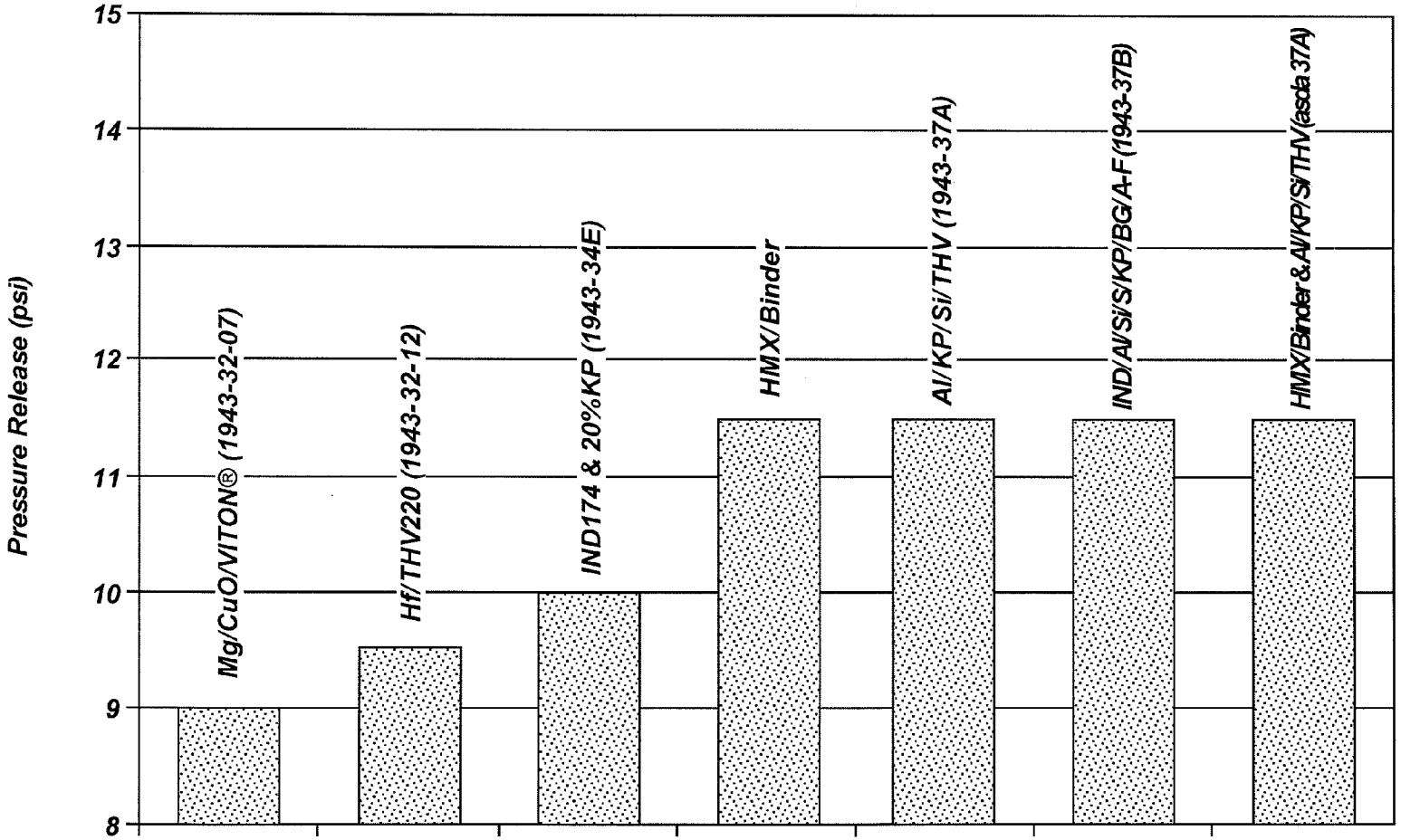

The best performing reactive materials were determined based on the formulations having the highest overpressure, earliest initiation (determined by the high-speed video and pressure curves), greatest plate damage, infrared intensity, or largest plume size/intensity (determined by the high-speed video). Several formulations of the reactive material were successful in more than one of these categories. Formulation Nos. 1791-100-2, 1943-32-03, 1943-32-12, PAX-2A, 1943-37A, and 1943-37B showed the best performance in plate damage in the bullets for thin-skinned targets, as shown in FIG. 54. Formulations 1943-32-03, 1943-32-12, 2002-1, 1943-37A, 1943-37B, and Pax 2A & 1943-37A showed the best performance for plume size in the bullets for thin-skinned targets, as shown in FIG. 55. Formulations 1943-32-07, 1943-32-12, 1943-34E, Pax-2A, 1943-37A, 1943-37B, and Pax 2A & 1943-37A showed the best performance for pressure output in the bullets for thin-skinned targets, as shown in FIG. 56.

Formulation Nos. 1791-100-2, 1943-32-12, and 1943-32-13 showed the best performance in plate damage in the bullets for thicker-skinned targets, as shown in Table 8. Formulations 1943-32-11, 1943-32-03, 1943-32-07, and 1943-32-12 showed the best performance for plume size in the bullets for thicker-skinned targets, as shown in Table 8. Formulations 1791-100-2, 1943-32-13, 1943-32-07, 1943-32-12, and Pax-2A showed the best performance for pressure output in the bullets for thicker-skinned targets, as shown in Table 8.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A reactive material, consisting of:

a metal selected from the group consisting of magnesium, zirconium, aluminum, titanium, and hafnium;

cupric oxide; and a copolymer of vinylidenefluoride-hexafluoropropylene.

2. The reactive material of claim 1, wherein the cupric oxide comprises from approximately 10% by weight to approximately 81% by weight of the reactive material.

3. A reactive material projectile, comprising:

a case having a reactive material disposed therein, and a tip, wherein the reactive material consists of a metal selected from the group consisting of magnesium, zirconium, aluminum, titanium, and hafnium, from approximately 18% by weight to approximately 78% by weight cupric oxide, and a copolymer of vinylidenefluoride-hexafluoropropylene.

4. The reactive material projectile of claim 3, wherein the reactive material is formulated to initiate upon impact of the reactive material projectile with a target.

5. A reactive material, consisting of:

a metal selected from the group consisting of magnesium, zirconium, aluminum, titanium, and hafnium;

from approximately 18% by weight to approximately 78% by weight cupric oxide; and a copolymer of vinylidenefluoride-hexafluoropropylene.

6. The reactive material of claim 5, wherein the reactive material consists of magnesium, cupric oxide, and a copolymer of vinylidenefluoride-hexafluoropropylene.

7. The reactive material of claim 5, wherein the reactive material consists of zirconium, cupric oxide, and a copolymer of vinylidenefluoride-hexafluoropropylene.

8. The reactive material of claim 5, wherein the reactive material consists of aluminum, cupric oxide, and a copolymer of vinylidenefluoride-hexafluoropropylene.

9. The reactive material of claim 5, wherein the reactive material consists of titanium, cupric oxide, and a copolymer of vinylidenefluoride-hexafluoropropylene.

10. The reactive material of claim 5, wherein the reactive material consists of hafnium, cupric oxide, and a copolymer of vinylidenefluoride-hexafluoropropylene.

11. The reactive material of claim 5, wherein the metal comprises from approximately 15% by weight to approximately 90% by weight of the reactive material.

12. The reactive material of claim 5, wherein the metal comprises from approximately 10% by weight to approximately 90% by weight of the reactive material.

13. The reactive material of claim 5, wherein the cupric oxide has a particle size ranging from approximately 20 nm to approximately 200 μm. wherein initiation of the reactive material occurs upon impact.

* * * * *